US010317826B2

(12) United States Patent
Park et al.

(10) Patent No.: US 10,317,826 B2
(45) Date of Patent: Jun. 11, 2019

(54) FIXING DEVICE AND IMAGE FORMING DEVICE HAVING SAME

(71) Applicant: HP PRINTING KOREA CO., LTD., Suwon-si, Gyeonggi-Do (KR)

(72) Inventors: Ji Su Park, Suwon (KR); Soo Hwan Bae, Suwon (KR); Dong Woo Lee, Suwon (KR); Dong Jin Seol, Suwon (KR); Jun Tae Kim, Suwon (KR)

(73) Assignee: HP PRINTING KOREA, CO., LTD., Suwon-si (KR)

( * ) Notice: Subject to any disclaimer, the term of this patent is extended or adjusted under 35 U.S.C. 154(b) by 0 days.

(21) Appl. No.: 15/918,515

(22) Filed: Mar. 12, 2018

(65) Prior Publication Data

US 2018/0203387 A1 Jul. 19, 2018

Related U.S. Application Data

(63) Continuation of application No. 15/033,791, filed as application No. PCT/KR2014/006176 on Jul. 9, 2014, now Pat. No. 9,952,540.

(30) Foreign Application Priority Data

Nov. 1, 2013 (KR) ..... 10-2013-0132498

(51) Int. Cl.
*G03G 15/20* (2006.01)

(52) U.S. Cl.
CPC . *G03G 15/2053* (2013.01); *G03G 2215/0148* (2013.01); *G03G 2215/2038* (2013.01)

(58) Field of Classification Search
CPC ..... G03G 15/2053; G03G 15/2064; G03G 15/2085; G03G 2215/2016; G03G 2215/0148; G03G 2215/2038
See application file for complete search history.

(56) References Cited

U.S. PATENT DOCUMENTS

| | | | | |
|---|---|---|---|---|
| 8,457,540 | B2 * | 6/2013 | Muramatsu | G03G 15/2064 399/329 |
| 2011/0274453 | A1 * | 11/2011 | Shimokawa | G03G 15/2064 399/45 |
| 2012/0107029 | A1 | 5/2012 | Moon | |
| 2012/0121303 | A1 | 5/2012 | Takagi | |
| 2013/0136515 | A1 | 5/2013 | Sahara | |
| 2013/0183069 | A1 | 7/2013 | Sakai | |
| 2013/0251420 | A1 * | 9/2013 | Okabe | G03G 15/2053 399/329 |
| 2013/0266355 | A1 * | 10/2013 | Yoshiura | G03G 15/2017 399/329 |

* cited by examiner

*Primary Examiner* — Hoang X Ngo
(74) *Attorney, Agent, or Firm* — Staas & Halsey LLP

(57) ABSTRACT

A fixing device comprising a fixing belt, a rotating member arranged to be in engagement with an outer circumferential surface of the fixing belt, a nip forming member to press the fixing belt, to form a fixing nip between the fixing belt and the rotating member, and sliding members on both ends of the fixing belt and to rotate together with the fixing belt.

20 Claims, 24 Drawing Sheets

FIXING DEVICE AND IMAGE FORMING DEVICE HAVING SAME

CROSS-REFERENCE TO RELATED APPLICATIONS

This application is a continuation application of U.S. patent application Ser. No. 15/033,791, filed on May 2, 2016, which is a U.S. National Stage Application, which claims the benefit under 35 U.S.C. § 371 of PCT International Patent Application No. PCT/KR2014/006176, filed Jul. 9, 2014, which claims the foreign priority benefit under 35 U.S.C. § 119 of Korean Patent Application No. 10-2013-0132498, filed Nov. 1, 2013, the contents of which are incorporated herein by reference.

BACKGROUND

An image forming apparatus forms an image on a printing medium and includes a printer, a copier, a facsimile machine, a multi-function device combining functions of the aforementioned devices, and the like.

An image forming apparatus using electrophotography emits light onto a photosensitive body charged with a predetermined electric potential and then forms an electrostatic latent image on a surface of the photosensitive body, to thereby form a visible image by supplying toner onto the electrostatic latent image. The visible image formed on the photosensitive body may be directly transferred to a printing medium or transferred to the printing medium via an intermediate transfer body, and the visible image transferred to the printing medium may be fixed onto the printing medium while being passed through a fixing device.

In general, a belt-type fixing device is equipped with a heat source, a heating member made of a belt, and a pressing member contacting tightly to the heating member to form a fixing nip. When the printing medium to which a toner image is transferred is fed between the heating member and the pressing member, the toner image is fixed onto the printing medium by heat radiating from the heating member and pressure applying to the fixing nip.

BRIEF DESCRIPTION OF THE DRAWINGS

FIG. 100 is a graph showing pressure distribution applied to a printing paper according to an example.

DETAILED DESCRIPTION

A shape of the belt is deformed in the vicinity of the fixing nip by the pressure applied by the pressing member and thus stress due to such a shape deformation of the belt is concentrated on both ends of the belt outside the fixing nip. Also, while the belt is rotating, stress is concentrated on the both ends of the belt due to shake or distortion of a belt rotation shaft. Furthermore, while the belt is rotating, the both ends of the belt may easily undergo abrasion compared to other portions of the belt due to friction between the belt and a structure and the like, which rotatably support the both ends of the belt. Due to stress concentration on the both ends of the belt and friction between the belt and the supporting structure and the like, the both ends of the belt may be more easily damaged than other portions thereof. Examples will be described in detail with reference to the accompanying drawings.

Figure 1:
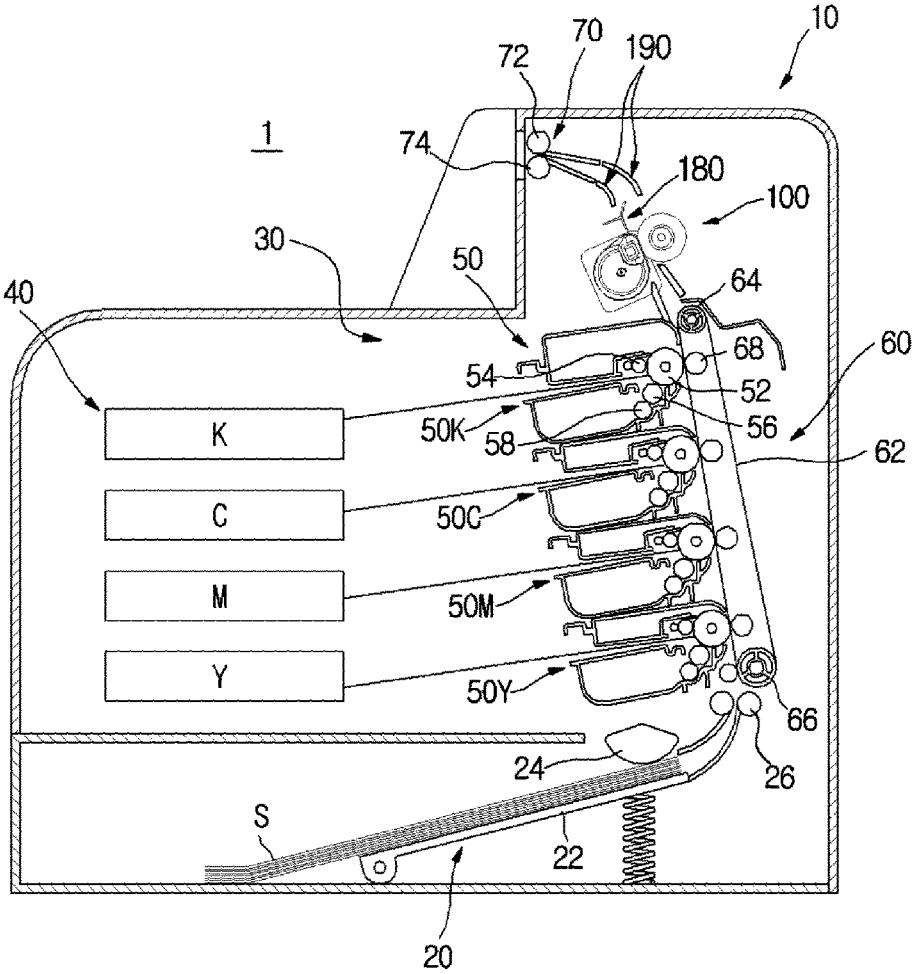
FIG. 1 is a diagram illustrating an image forming apparatus according to an example.

FIG. 1 is a diagram illustrating a configuration of an image forming apparatus according to an example. As shown in FIG. 1, an image forming apparatus 1 includes a main body 10, a printing medium feeding device 20, a printing device 30, a fixing device 100, and a printing medium discharge device 70.

The main body 10, 10*a* and 10*b* forms an external appearance of the image forming apparatus 1, and supports a variety of components to be installed therein. The main body 10 includes a cover (not shown) provided to open and close a portion thereof, and a main body frame (not shown) for internally supporting or fastening the variety of components.

The printing medium feeding device 20 feeds the printing device 30 with a printing medium S. The printing medium feeding device 20 is equipped with a tray 22 for storing the printing medium S therein, and a pick-up roller 24 for picking up the printing media stored in the tray 22 one by one. The printing medium picked up by the pick-up roller 24 is fed toward the printing device 30 through a transport roller 26.

The printing device 30 may include an optical scanning device 40, a developing device 50, and a transfer device 60.

The optical scanning device 40 includes an optical system (not shown) to emit light corresponding to image information of yellow Y, magenta M, cyan C, and black K colors to the developing device 50 in response to a print signal.

The developing device 50 forms a toner image according to the image information input from an external device including a computer and the like. The image forming apparatus 1 according to an example is a color image forming apparatus, and thus the developing device 50 is comprised of four developing devices 50Y, 50M, 50C, and 50K, each of which has toner of a color, for example, yellow Y, magenta M, cyan C, or black K color, different from each other.

Each of the developing devices 50Y, 50M, 50C, and 50K may be equipped with a photosensitive body 52 on which an electrostatic latent image is formed on a surface thereof by the optical scanning device 40, a charging roller 54 for charging the photosensitive body 52, a developing roller 56 for supplying the toner image to the electrostatic latent image formed on the photosensitive body 52, and a supply roller 58 for supplying the toner to the developing roller 56.

The transfer device 60 transfers the toner image formed on the photosensitive body 52 to the printing medium. The transfer device 60 may include a transfer belt 62 for circularly running in contact with each of the photosensitive bodies 52, a transfer belt driving roller 64 for driving the transfer belt 62, a tension roller 66 for maintaining tension of the transfer belt 62, and four transfer rollers 68 for transferring the toner image developed on the photosensitive body 52 to the printing medium.

The printing medium is attached to the transfer belt 62 to be transported at the same speed as a running speed of the transfer belt 62. At this point, a voltage having polarity opposite to that of the toner attached to each photosensitive body 52 is applied to each transfer roller 68, such that the toner image on each photosensitive body 52 is transferred onto the printing medium.

The fixing device 100 fixes the toner image that is transferred by the transfer device 60 onto the printing medium. Detailed description of the fixing device 100 will be described later.

Meanwhile, the printing medium discharge device 70 discharges the printing medium outside the main body 10. The printing medium discharge device 70 includes a discharge roller 72, and a pinch roller 74 disposed opposite to the discharge roller 72.

Figure 2:
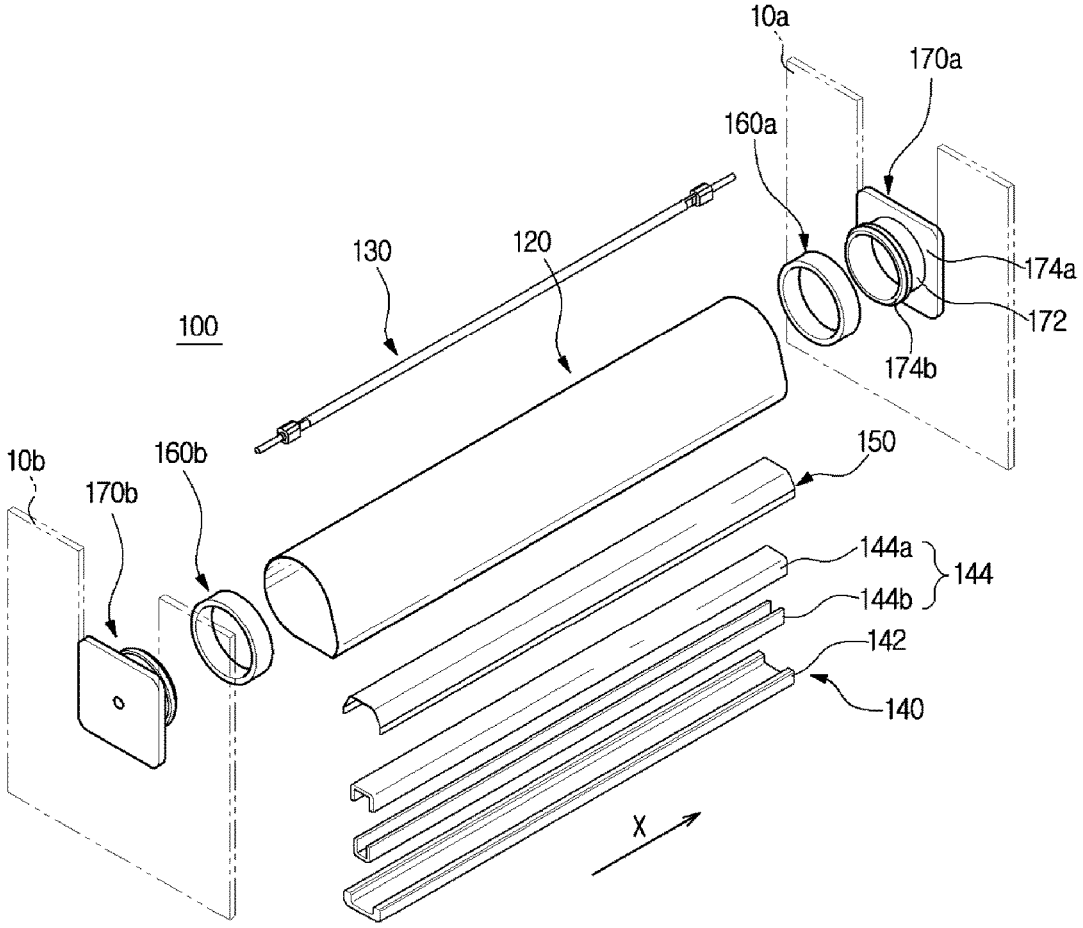
FIG. 2 is an exploded perspective diagram of a fixing device according to an example.
Figure 3:
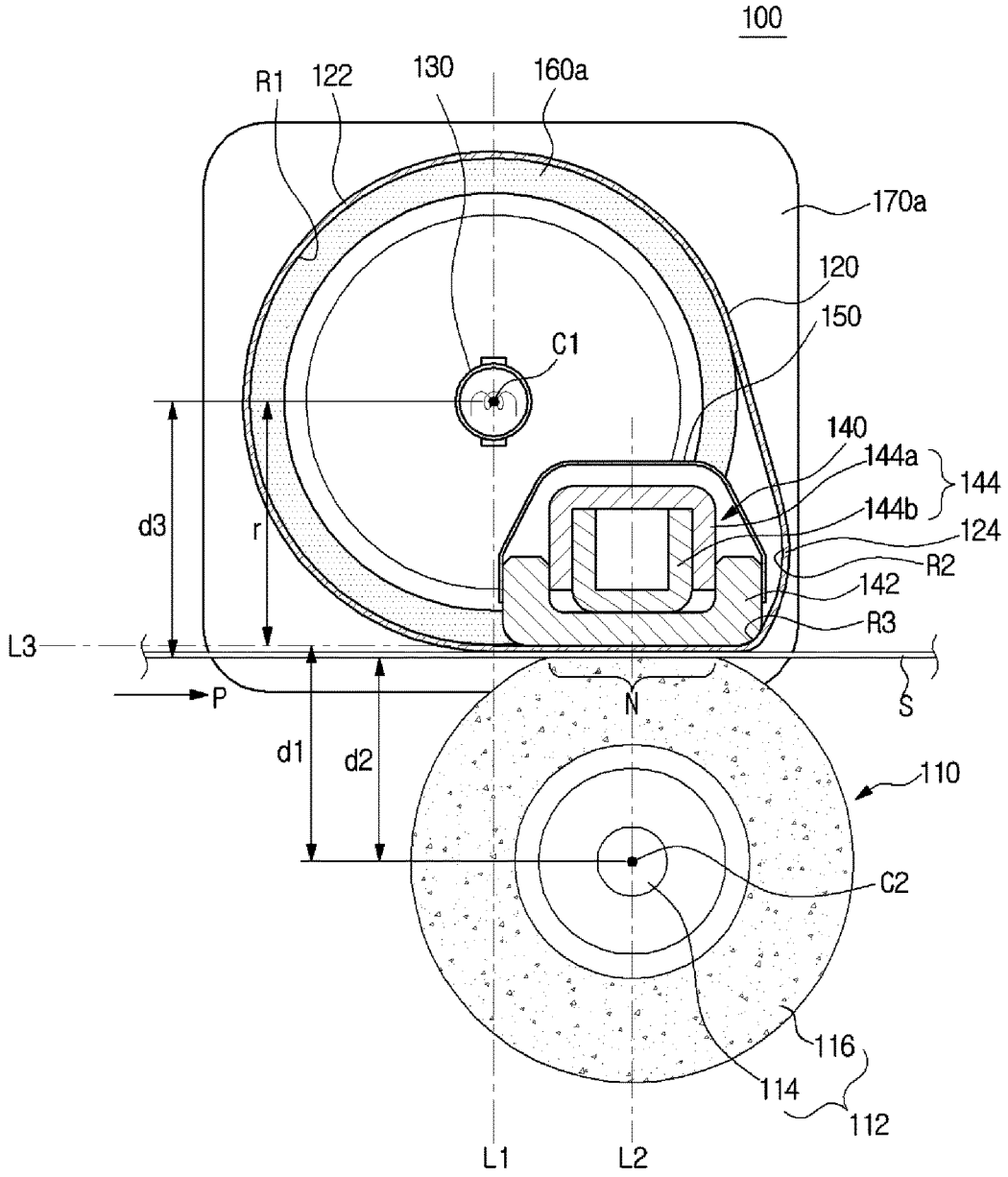
FIG. 3 is a cross-sectional diagram of the fixing device according to an example.

FIG. 2 is an exploded perspective diagram of the fixing device according to an example and FIG. 3 is a cross-sectional diagram of the fixing device according to an example.

Hereinafter, a width direction of the printing medium S, a width direction of a rotating member 110, and a width direction of a fixing belt 120 are defined to mean the same direction X.

As shown in FIGS. 2 and 3, the fixing device 100 includes the rotating member 110, the fixing belt 120, a heat source 130, a nip forming member 140, a thermal insulation member 150, sliding members 160*a* and 160*b*, and flange members 170*a* and 170*b*.

The printing medium S to which the toner image has been transferred is passed between the rotating member 110 and the fixing belt 120, and then, at this point, the toner image is fixed onto the printing medium by heat and pressure.

The rotating member 110 is arranged to be in engagement with an outer circumferential surface of the fixing belt 120 to form a fixing nip N between the fixing belt 120 and the rotating member 110. The rotating member 110 may be comprised of a fixing roller 112 receiving power from a driving source (not shown) to be rotated.

The fixing roller 112 has a shaft 114 made of a metallic material including aluminum, steel, and the like, and an elastic layer 116 to be elastically deformable to form the fixing nip N between the fixing belt 120 and the elastic layer 116. The elastic layer 116 is generally formed of a silicone rubber. It is preferable that the elastic layer 116 has a hardness equal to or greater than 50 and equal to or less than 80 based on the ASKER-C hardness so as to apply a high fixing pressure to the printing medium S in the fixing nip N, and also has a thickness equal to or greater than 3 millimeter (mm) and equal to or less than 6 mm. A release layer (not shown) may be provided on a surface of the elastic layer 116 to prevent the printing medium from sticking to the fixing roller 112.

The fixing belt 120 rotates in engagement with the fixing roller 112 to form the fixing nip N together with the fixing roller 112, and is heated by the heat source 130 to deliver heat to the printing medium S being passed through the fixing nip N. The fixing belt 120 may be comprised of a single layer made of metal, a heat-resistant polymer, and the like, or may be configured by adding an elastic layer and a protective layer to a base layer formed of metal or a heat-resistant polymer. An inner surface of the fixing belt 120 may be tinted with a black color or coated so as to facilitate heat absorption.

The heat source 130 is arranged to directly radiant-heat at least a portion of an inner circumferential surface of the fixing belt 120. In order to improve a fixing performance, at least two or more heat sources 130 may be arranged. A halogen lamp may be used as the heat source 130.

The nip forming member 140 pressurizes the inner circumferential surface of the fixing belt 120 to form the fixing nip N between the fixing belt 120 and the rotating member 110. The nip forming member 140 may be formed of a material having excellent strength including stainless steel, carbon steel, and the like.

The nip forming member 140 includes a guide member 142 for guiding the fixing belt 120 in contact with the inner surface thereof, and a support member 144 arranged on an upper portion of the guide member 142 to pressurize and support the guide member 142.

Since a bending deformation occurs significantly if the support member 144 has a low rigidity, the fixing nip N may be not evenly pressurized. Therefore, in order to reduce the bending deformation, the support member 144 includes a first support member 144*a* having an arcuate cross-section and a second support member 144*b* having a reverse arcuate cross-section, and the first support member 144*a* and the second support member 144*b* are coupled to each other so as to allow an inside of the first support member 144*a* to accommodate at least a portion of the second support member 144*b*. The first support member 144*a* and the second support member 144*b* may be formed of a structure having a high cross-sectional area moment of inertia such as an I beam shape, an H beam shape, and the like, besides the arcuate or reverse arcuate cross-section shape.

The guide member 142 is in contact with the inner surface of the fixing belt 120 to form the fixing nip N, and guides the fixing belt 120 so as to enable the fixing belt 120 to run smoothly in the vicinity of the fixing nip N.

The guide member 142 is provided in a reverse arcuate cross-section shape to accommodate the support member 144 therein. The thermal insulation member 150, which will be described later, is coupled to both lateral sides of the guide member 142.

The thermal insulation member 150 prevents heat generated from the heat source 130 from directly radiating to the nip forming member 140. For this purpose, the thermal insulation member 150 is formed of an arcuate shape to cover the nip forming member 140, and both ends of the thermal insulation member 150 are respectively coupled to the both lateral sides of the guide member 142.

A reflective layer for reflecting heat from the heat source 130 may be provided on a surface of the thermal insulation member 150 facing the fixing belt 120. The reflective layer may be formed by coating the thermal insulation member 150 with a reflective material including silver and the like. By forming the reflective layer on the thermal insulation member 150 as described above, heat radiating to the thermal insulation member 150 may be reflected toward the fixing belt 120 to promote heating thereof.

The sliding members 160*a* and 160*b* are respectively arranged on inner surfaces of both ends of the fixing belt 120 toward an outer side of the fixing nip N to support rotation of the fixing belt 120.

The sliding members 160*a* and 160*b* have a ring shape and are respectively in contact with the inner surface of the fixing belt 120 to rotate together therewith. Therefore, as the sliding members 160*a* and 160*b* rotate together with the fixing belt 120, an abrasion phenomenon of the fixing belt 120, which is made of a softer material than that of the sliding members 160*a* and 160*b*, due to friction is prevented.

A rotation center C1 of each of the sliding members 160*a* and 160*b* is arranged at an upstream side compared to a rotation center C2 of the rotating member 110 along a feeding direction P of the printing medium being fed into the fixing nip N. As shown in FIG. 3, an offset occurs between a perpendicular line L1 passing through the rotation center C1 of each of the sliding members 160*a* and 160*b* and a perpendicular line L2 passing through the rotation center C2 of the rotating member 110.

All regions on outer circumferential surfaces of the sliding members 160*a* and 160*b* are arranged at positions equal to or higher than a position of the fixing nip N. As shown in FIG. 3, in the vicinity of the fixing nip N, a shortest distance d1 between a tangent line L3, which is in parallel with the fixing nip N, of the outer circumferential surface of each of the sliding members 160*a* and 160*b* and the rotation center C2 of the rotating member 110 is equal to or greater than a shortest distance d2 between the fixing nip N and the rotation center C2 of the rotating member 110. Also, a shortest distance d3 between the rotation center C1 of each of the sliding members 160*a* and 160*b* and an outer circumferential surface of the rotating member 110 is equal to or greater than a radius r of each of the sliding members 160*a* and 160*b*.

Figure 4A:
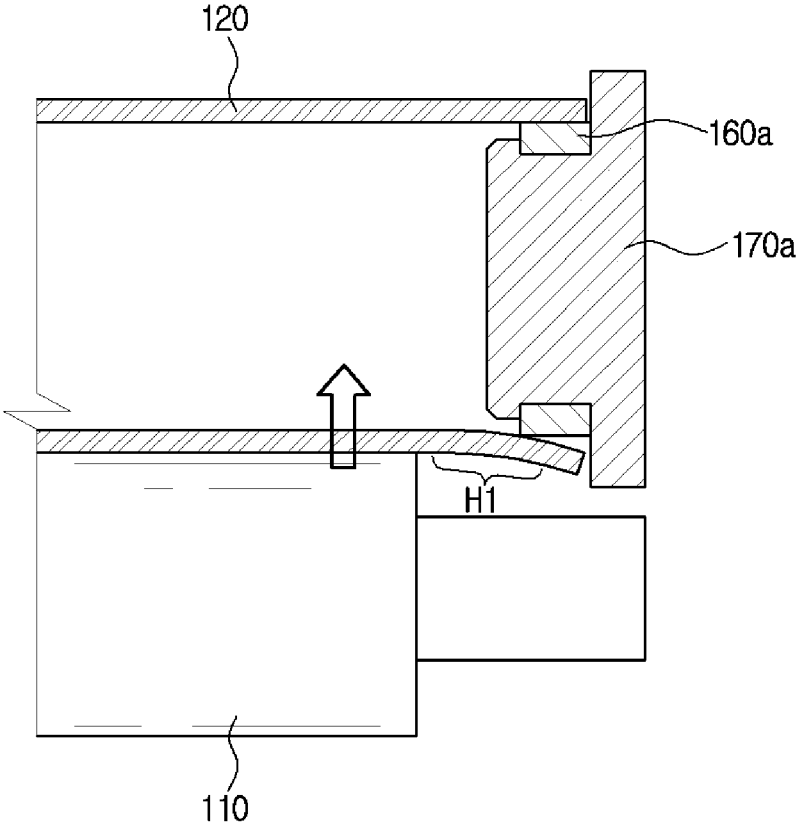
FIGS. 4A and 4B are diagrams for describing a position relationship between a sliding member and a fixing nip according to an example.
Figure 4B:
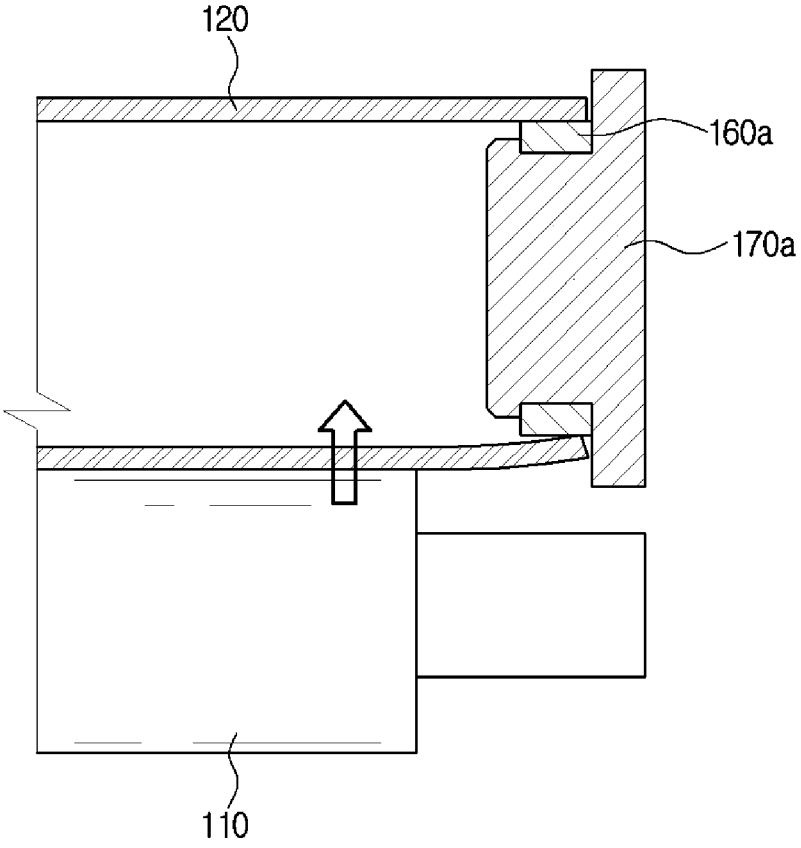

FIGS. 4A and 4B are diagrams for describing a position relationship between the sliding members and the fixing nip.

As shown in FIG. 4A, when the sliding members 160*a* and 160*b* are arranged so as to position portions of the outer circumferential surfaces thereof at regions lower than the fixing nip N, a bending deformation occurs at the both ends of the fixing belt 120 in a boundary region H1 of the fixing nip N to concentrate stress on the both ends of the fixing belt 120, and if the fixing belt 120 consistently rotates and runs under such a condition, fatigue due to the stress concentration may be accumulated to cause an easy destruction of the both ends of the fixing belt 120.

As shown in FIG. 4B, when all regions on the outer circumferential surface of each of the sliding members 160*a* and 160*b* are arranged at positions equal to or higher than a position of the fixing nip N, a bending deformation at the both ends of the fixing belt 120 is small in the boundary of the fixing nip N such that stress concentration is alleviated, or the bending deformation at the both ends of the fixing belt 120 does not occur to prevent stress from concentrating.

Figure 5A:
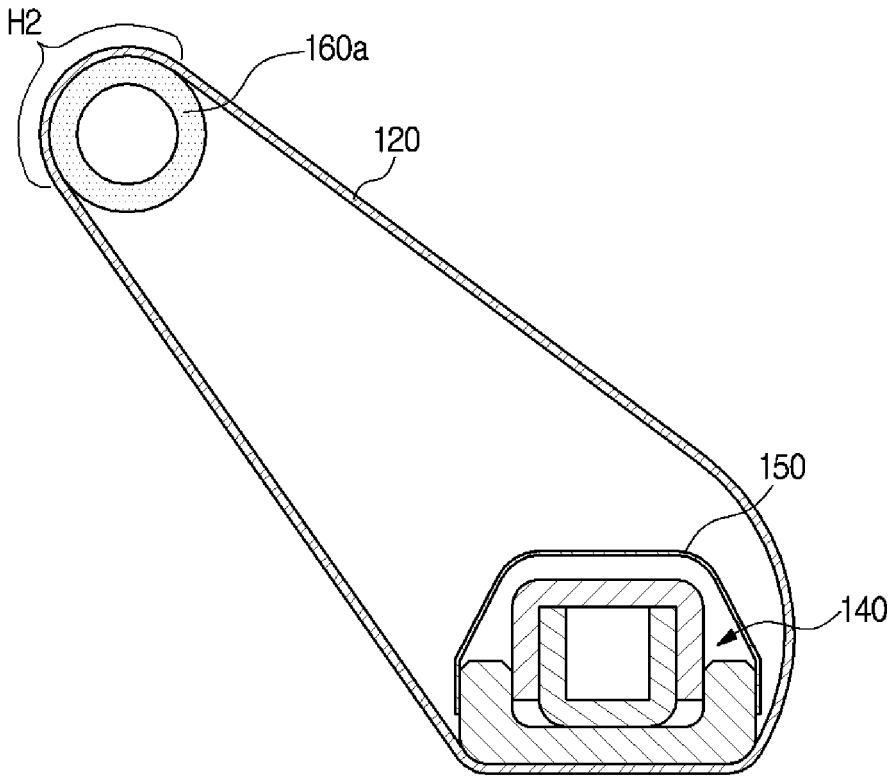
FIGS. 5A and 5B are diagrams for describing a relationship between a circumference of an outer surface of the sliding member and a circumference of an inner surface of a fixing belt according to an example.
Figure 5B:
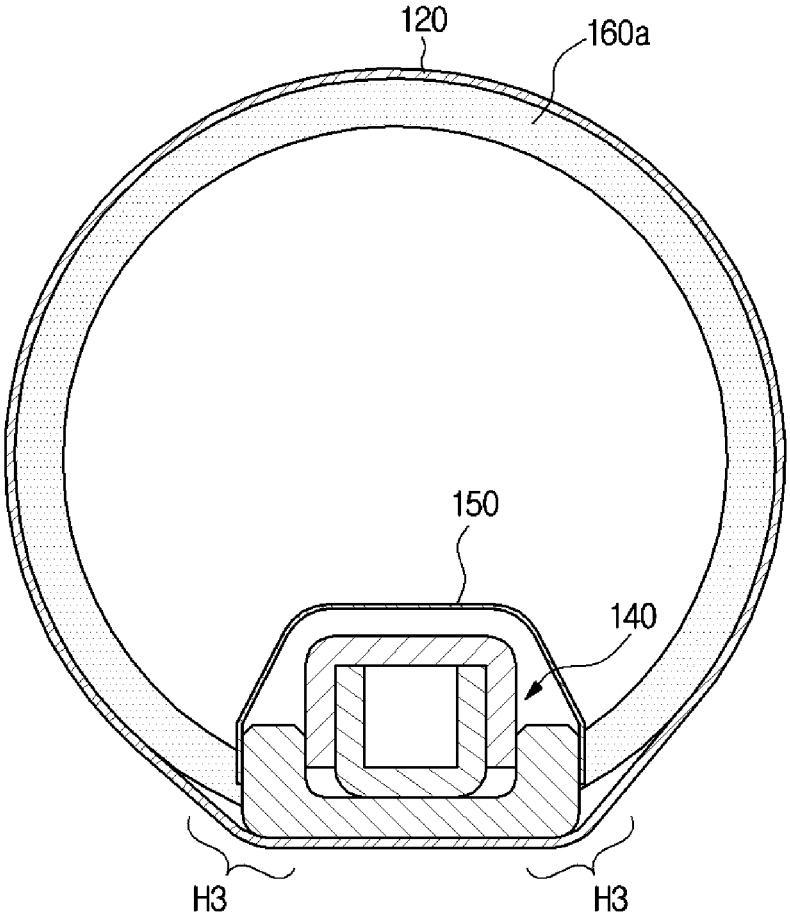

Also, in order to prevent the fixing belt 120 from being easily destroyed by the fatigue due to the stress concentration, a ratio between a circumference of the outer circumferential surface of each of the sliding members 160*a* and 160*b* and a circumference of the inner surface of the fixing belt may preferably be equal to or greater than 0.15 and equal to or less than 0.98. FIGS. 5A and 5B are diagrams for describing a relationship between the circumference of an outer surface of each of the sliding members and the circumference of the inner surface of the fixing belt.

FIG. 5A illustrates a shape of the fixing belt 120 when a ratio between the circumference of the outer circumferential surface of each of the sliding members 160*a* and 160*b* and the circumference of the inner surface of the fixing belt 120 is less than 0.15. As shown in FIG. 5A, if the ratio between the circumference of the outer circumferential surface of each of the sliding members 160*a* and 160*b* and the circumference of the inner surface of the fixing belt 120 is less than 0.15, a curvature of the fixing belt 120 at a portion H2 in contact with the sliding members 160*a* and 160*b* is increased such that stress is concentrated on portions of the fixing belt 120 in contact with the sliding members 160*a* and 160*b*. If the fixing belt 120 consistently rotates and runs under such a condition, fatigue due to the stress concentration may be accumulated to cause an easy destruction of the fixing belt 120.

FIG. 5B illustrates a shape of the fixing belt 120 when a ratio between the circumference of the outer circumferential surface of each of the sliding members 160*a* and 160*b* and the circumference of the inner surface of the fixing belt 120 is greater than 0.98. As shown in FIG. 5B, if the ratio between the circumference of the outer circumferential surface of each of the sliding members 160*a* and 160*b* and the circumference of the inner surface of the fixing belt 120 is greater than 0.98, curvatures of the fixing belt 120 at both boundary regions H3 of the fixing nip N are relatively increased such that stress is concentrated on portions of the fixing belt 120 corresponding to the both boundary regions of the fixing nip N. If the fixing belt 120 consistently rotates and runs under such a condition, fatigue due to the stress concentration may be accumulated to cause an easy destruction of the fixing belt 120.

The flange members 170*a* and 170*b* include rotation supporters 172 having a cylindrical shape for rotatably supporting the sliding members 160*a* and 160*b* in contact with inner circumferential surfaces thereof, and release preventers 174*a* and 174*b* provided on both sides of each of the rotation supporters 172 to prevent the sliding members 160*a* and 160*b* from being released in the axial direction X.

The sliding members 160*a* and 160*b* are rotatably supported by the flange members 170*a* and 170*b* and the fixing belt 120 rotates and runs at all times in contact with the sliding members 160*a* and 160*b*, so that a phenomenon of shake or distortion of the fixing belt 120 is prevented while the fixing belt 120 is rotating and running.

As shown in FIG. 3, while rotating and running, the fixing belt 120 is divided into a first portion 122 in contact with the sliding members 160*a* and 160*b*, and a second portion 124 in non-contact with the sliding members 160*a* and 160*b*. The first portion 122 is disposed at an upstream side compared to the second portion 124 along the feeding direction P of the printing medium being fed into the fixing nip N, the fixing nip N is formed between the first portion 122 and the second portion 124, and a radius of curvature R1 of the first portion 122 is greater than a radius of curvature R2 of at least a section of the second portion 124.

The fixing nip N extends from the first portion 122 substantially in a tangential direction thereof without unevenness. The unevenness does not occur at a portion of the fixing belt 120 where the first portion 122 and the fixing nip N are connected to each other, such that stress is not concentrated on this portion.

The printing medium S should be naturally separated from the fixing belt 120 or the rotating member 110 while being passed through and then escaped from the fixing nip N, so that a separating force equal to or greater than a predetermined magnitude should be applied between the fixing belt 120 and the toner layer on the printing medium S. The separating force between the fixing belt 120 and the toner layer is related to a curvature of the fixing belt 120 corresponding to a region where the printing medium S is escaped from the fixing nip N. If the curvature of the fixing belt 120 corresponding to the region where the printing medium S is escaped from the fixing nip N is increased, the separating force between the fixing belt 120 and the toner layer is increased, whereas, if the curvature of the fixing belt 120 corresponding to the region where the printing medium S is escaped from the fixing nip N is decreased, the separating force between the fixing belt 120 and the toner layer is decreased. Therefore, by increasing the curvature of the fixing belt 120 corresponding to the region where the printing medium S is escaped from the fixing nip N, the printing medium S may be naturally separated from the fixing belt 120 or the rotating member 110.

In order to allow the printing medium S to be escaped from the fixing nip N at a boundary between the fixing nip N and the second portion 124 and to be naturally separated from the fixing belt 120 or the rotating member 110, a portion of the second portion 124 connected to the fixing nip N may have a curvature 1/R3 greater than a curvature 1/R2 of the other portion of the second portion 124.

Hereinafter, examples of the fixing device will be described. The same configurations as the fixing device according to an example described above will be given the same reference numerals.

Figure 6:
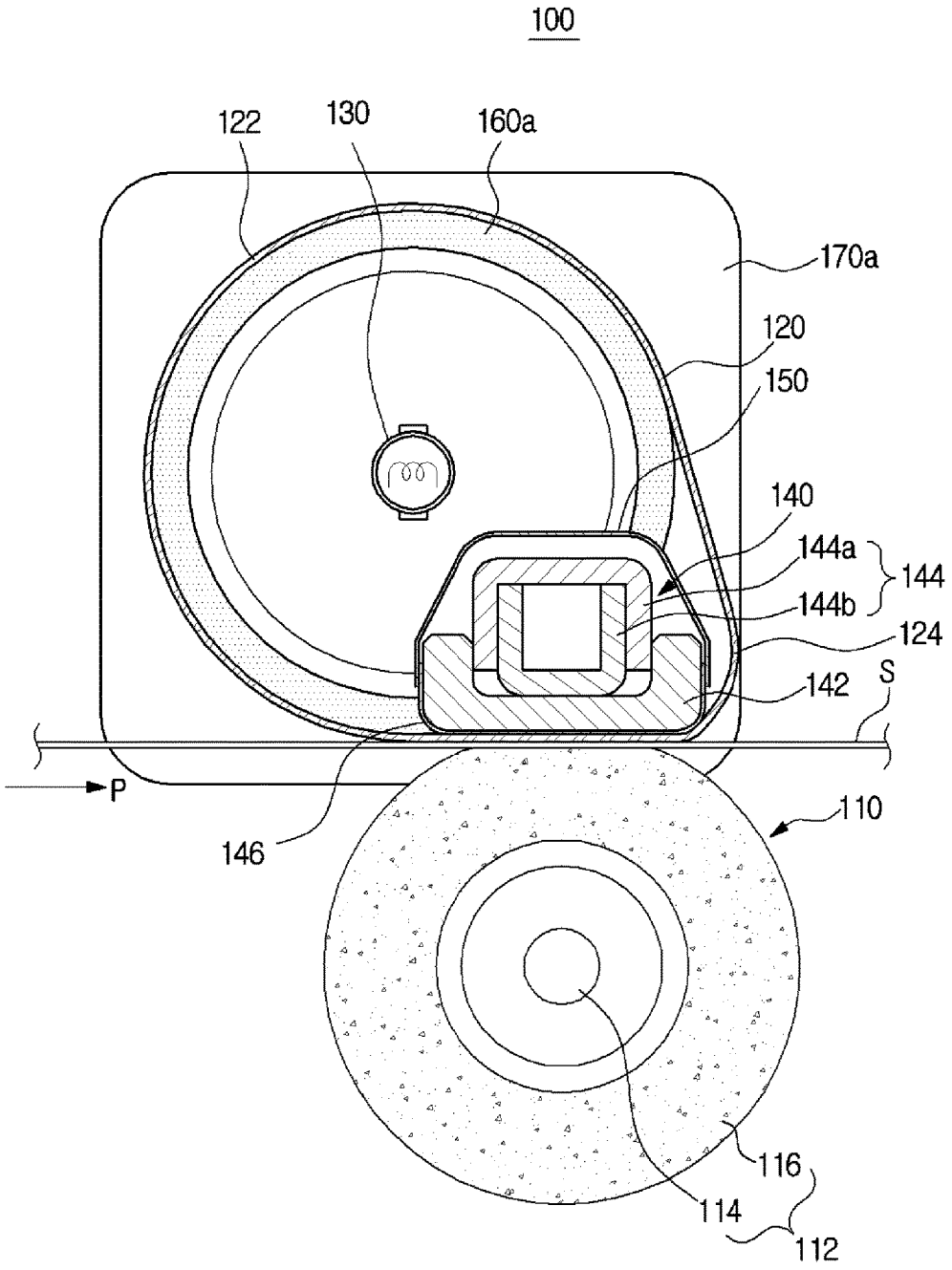
FIG. 6 is a cross-sectional diagram of a fixing device according to another example.

FIG. 6 is a cross-sectional diagram of a fixing device according to another example.

As shown in FIG. 6, the nip forming member 140 further includes a friction reducing plate 146.

The friction reducing plate 146 is arranged between the fixing belt 120 and the guide member 142 to reduce friction between the fixing belt 120 and the guide member 142 while the fixing belt 120 is rotating and running.

The friction reducing plate 146 is formed in a reverse arcuate shape to cover the guide member 142, and both ends of the friction reducing plate 146 are coupled to the both lateral sides of the guide member 142.

Figure 7A:
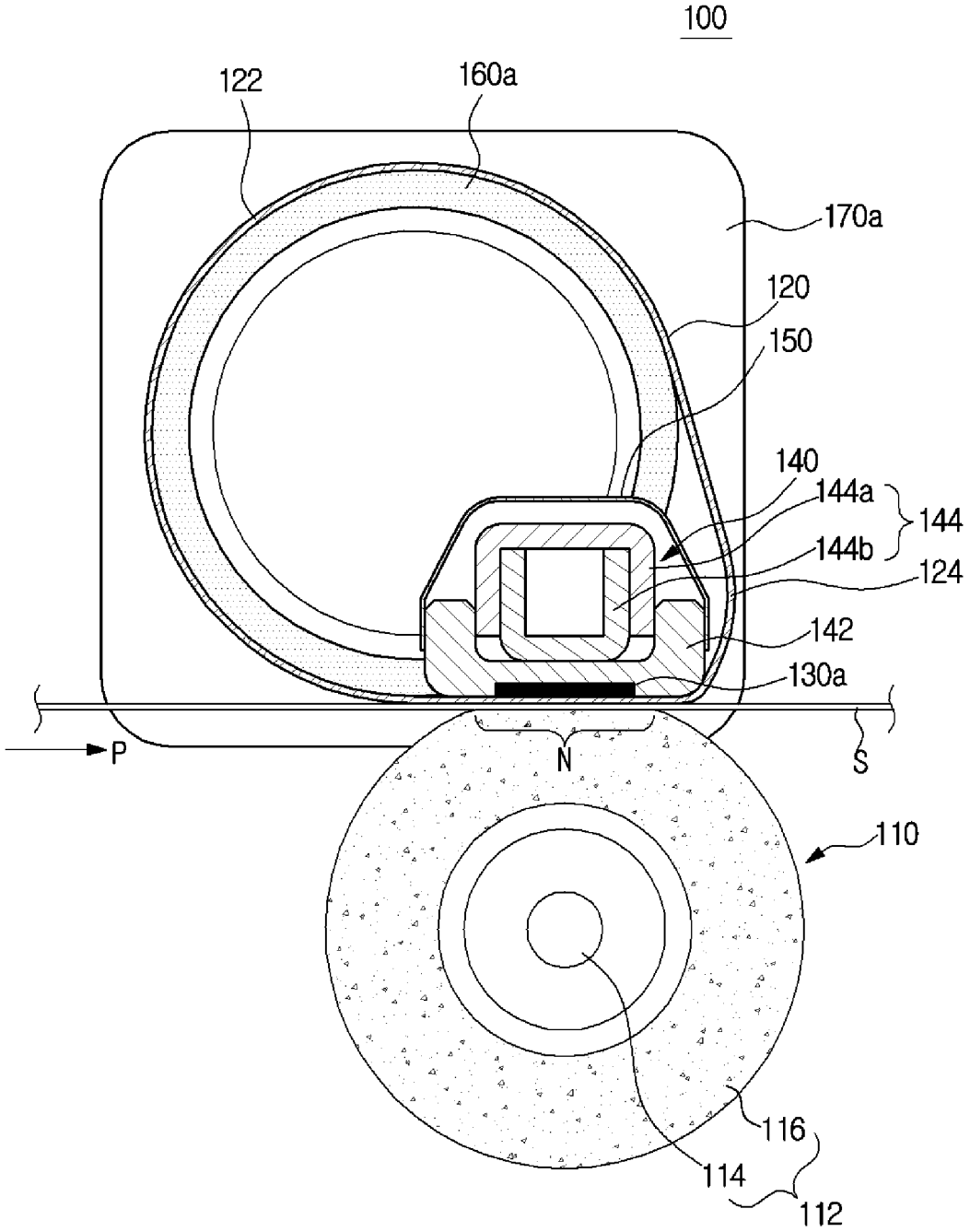
FIG. 7A is a diagram illustrating utilization of a ceramic heater as a heat source according to an example.
Figure 7B:
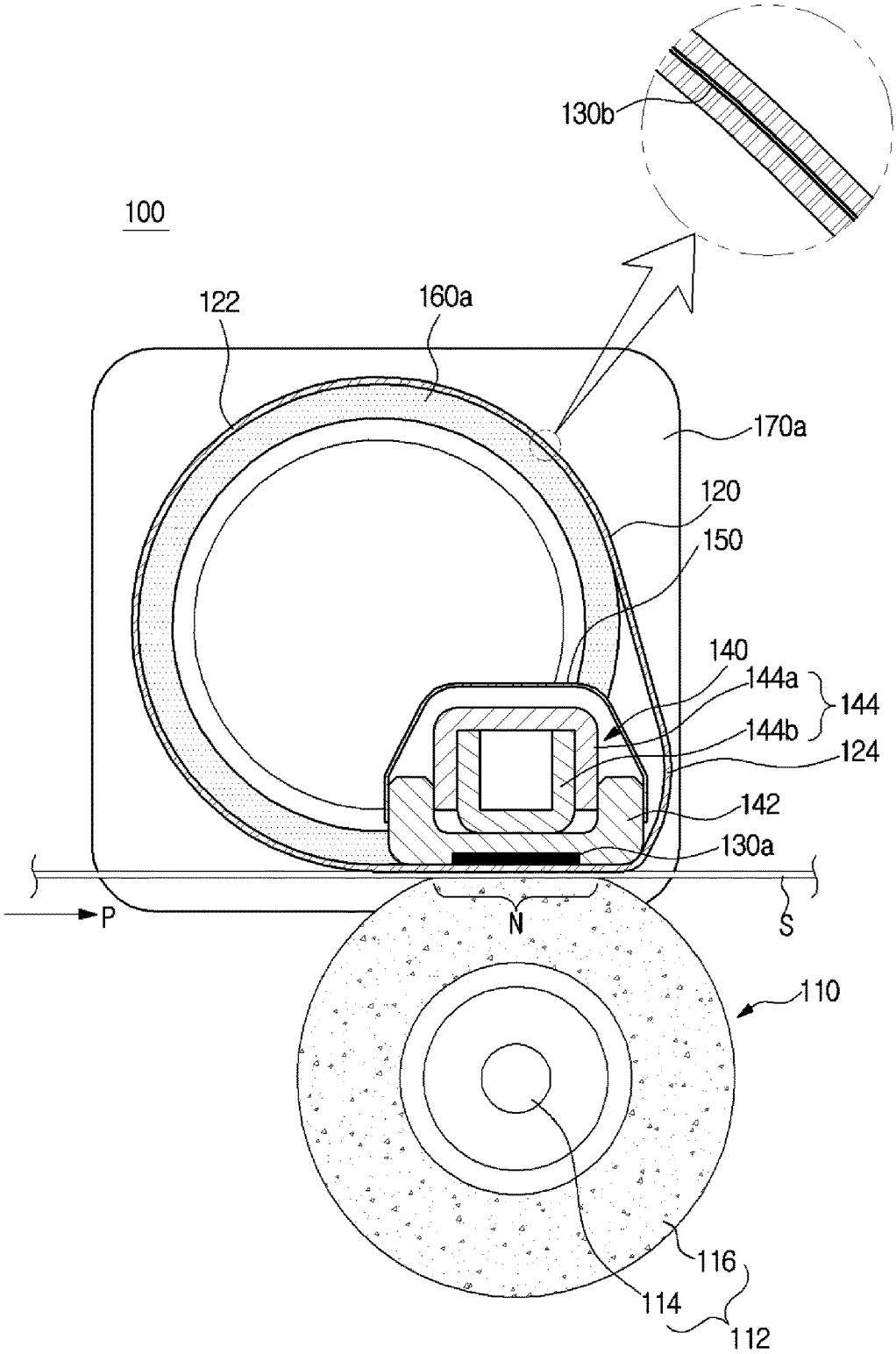
FIG. 7B is a diagram illustrating utilization of a planar heating element as the heat source according an example.

FIG. 7A is a diagram illustrating utilization of a ceramic heater as the heat source according to an example, and FIG. 7B is a diagram illustrating utilization of a planar heating element as the heat source according to an example.

As shown in FIG. 7A, a ceramic heater 130*a* arranged near the fixing nip N to directly heat the fixing belt 120 being passed through the fixing nip N may be used as the heat source. The ceramic heater 130*a* is coupled to a lower surface of the guide member 142.

As shown in FIG. 7B, a planar heating element 130*b* may be used as the heat source. The planar heating element 130*b* is a kind of an electrical resistor that generates heat when an electric current is supplied. The planar heating element 130*b* is extended along the circumference of the fixing belt 120, and is provided to form a layer inside the fixing belt 120.

Although not shown in the drawings, an induction heating heater as well as the halogen heater, the ceramic heater, and the planar heating element described above may be used as the heat source.

Figure 8:
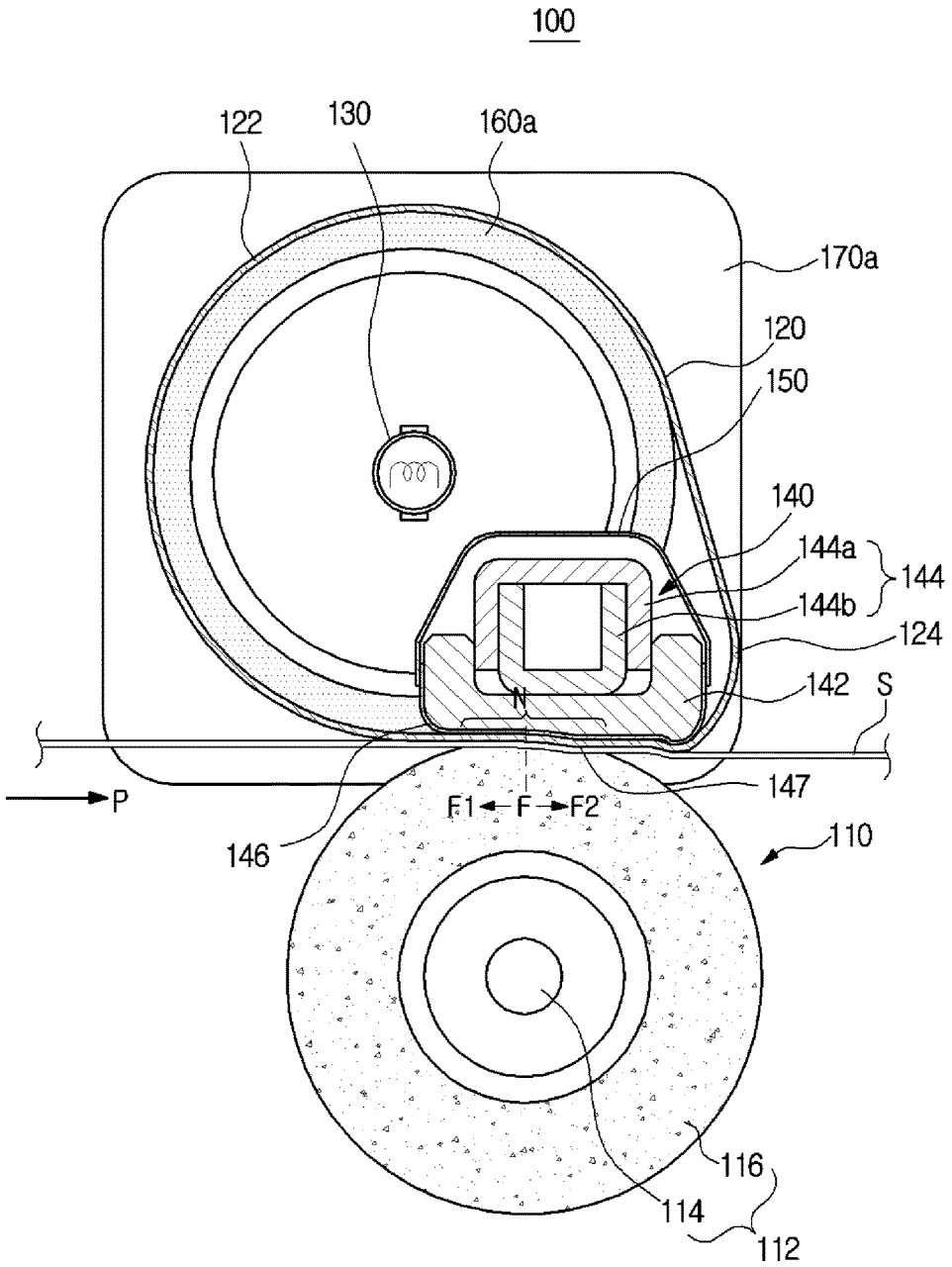
FIG. 8 is a cross-sectional diagram of a fixing device according to another example.
Figure 9:
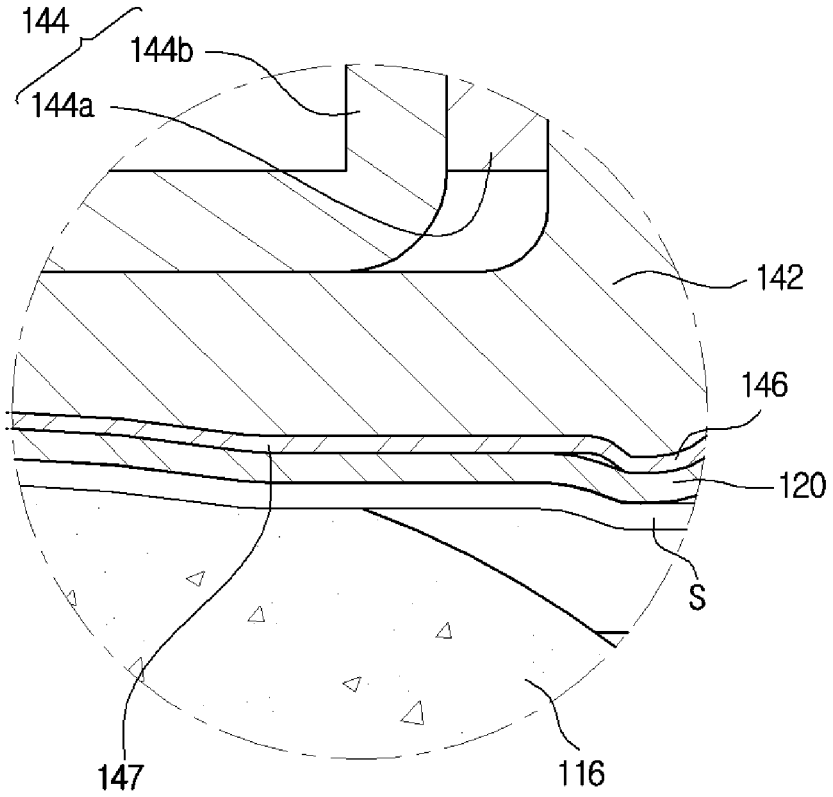
FIG. 9 is a diagram illustrating a part of the fixing device shown in FIG. 8.

FIG. 8 is a cross-sectional diagram of a fixing device according to according to an example, and FIG. 9 is a diagram illustrating a part of the fixing device shown in FIG. 8.

With reference to FIGS. 8 and 9, the fixing device 100 according to another example includes a protrusion 147 provided in a rear half of the fixing nip N. The protrusion 147 may be provided on a lower surface of the nip forming member 140.

The protrusion 147 may be formed by downwardly protruding a portion of a lower surface of the friction reducing plate 146. In the case that the friction reducing plate 146 is not provided, the protrusion 147 may be provided on the lower surface of the guide member 142 that guides the fixing belt 120 in contact with the inner surface thereof. Hereinafter, an example with the protrusion 147 provided on the lower surface of the friction reducing plate 146 will be described.

If a portion locating at a side where the printing medium S is fed into is referred to as a front half F1 of the fixing nip N, and a portion locating at a side where the printing medium S is escaped from the fixing nip N is referred to as a rear half F2 of the fixing nip N based on a center point F of the fixing nip N, the protrusion 147 may be formed on the rear half F2 of the fixing nip N.

For example, the protrusion 147 may be formed at a position locating at a distance that is approximately 80% of a total length of the fixing nip N from an inlet side thereof. The protrusion 147 may be formed to be adjacent to a tailing end of the rear half F2 of the fixing nip N so as to pressurize the printing medium S just before the printing medium S is escaped from the fixing nip N.

The printing medium S being passed through between the lower surface of the friction reducing plate 146 and the rotating member 110 may be pressurized by the protrusion 147 just before being escaped from the fixing nip N. The toner of a high temperature, which is sufficiently melted while passing through the fixing nip N, may be pressurized by the protrusion 147 to be fixed onto the printing medium S.

Before being escaped from the fixing nip N, the printing medium S may be subject to a maximum pressure at a lowest point of the protrusion 147. In this way, the toner transferred onto the printing medium S may be subject to the maximum pressure under a most melted state to be fixed onto the printing medium S.

Although the protrusion 147 according to an example has been formed as one on the lower surface of the friction reducing plate 146 is shown in FIGS. 8 and 9, the protrusion 147 may be provided as two or more. In the case that the friction reducing plate 146 is not provided, the protrusion 147 may be provided on a lower surface of a member, such as the guide member 142 and the like, for guiding formation of the fixing nip N in contact with the inner surface of the fixing belt 120.

In the related art, when being passed through the fixing device 100 in which the protrusion 147 is not formed, the printing medium S is subject to a maximum pressure at the center point F of the fixing nip N. When a peak pressure point exists at the center point F of the fixing nip N, the maximum pressure is applied under a state that the toner is not sufficiently softened such that a surface of an image, which is to be formed by the toner being fixed onto the printing medium S, may be not sleek to cause degradation of gloss or gloss uniformity of the image to be formed onto the printing medium S.

For example, the protrusion 147 is formed on the rear half F2 of the fixing nip N such that the maximum pressure may be applied by the protrusion 147 in a state in which the toner is sufficiently melted. The printing medium S is pressurized in the state in which the toner is sufficiently melted such that a surface of an image output onto the printing medium S may be sleekly formed to improve gloss or gloss uniformity of the output image in comparison with the related art.

Figure 10A:
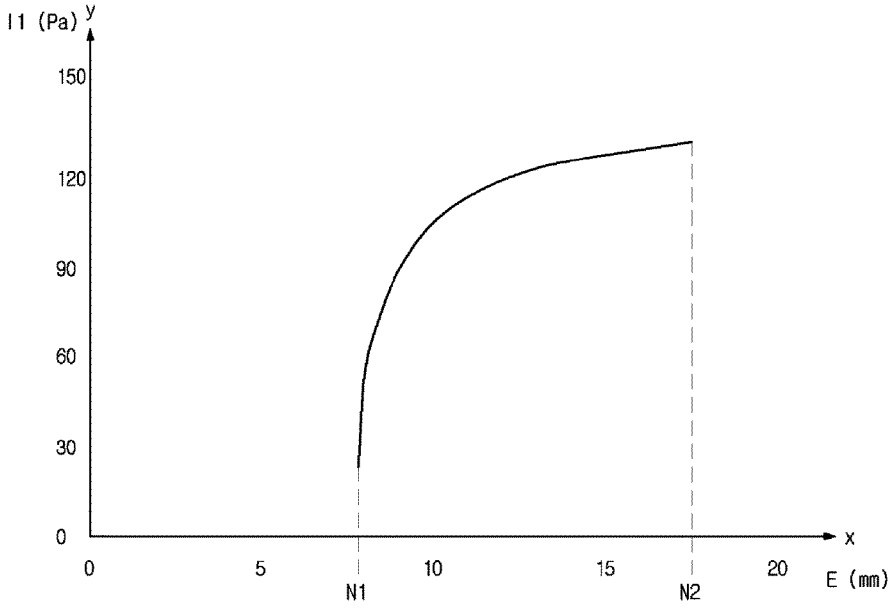
FIG. 10A is a diagram illustrating temperature variation of toner in the fixing device according to an example.
Figure 10B:
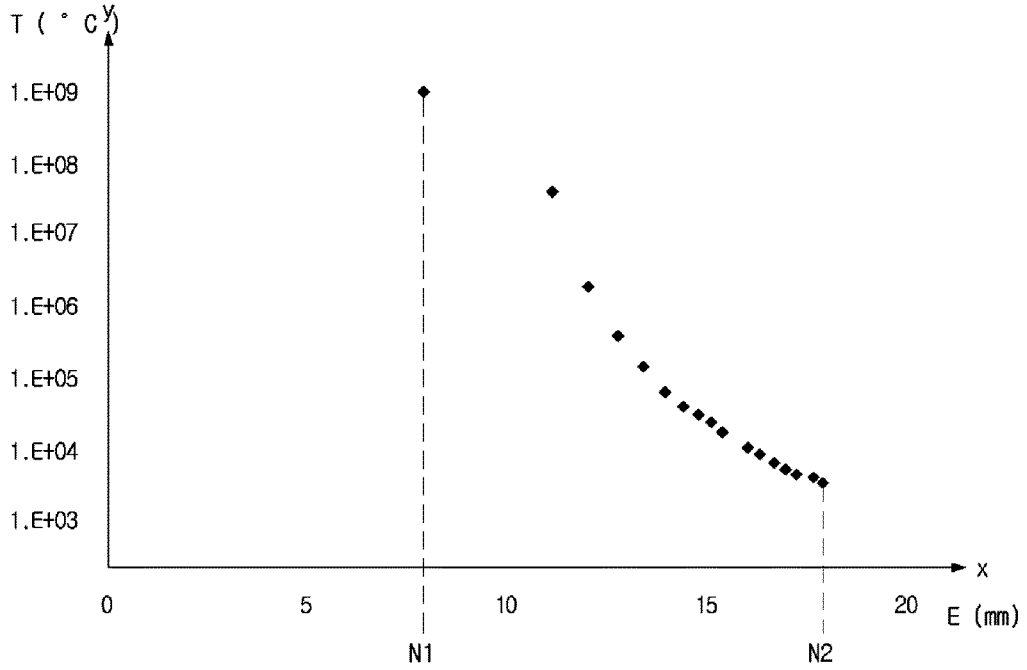
FIG. 10B is a diagram illustrating variation in physical properties of the toner in the fixing device according to an example.

FIG. 10A is a diagram illustrating temperature variation of the toner in the fixing device according to an example, and FIG. 10B is a diagram illustrating variation in physical properties of the toner in the fixing device according to an example.

FIG. 10A is the diagram illustrating the temperature variation of the toner being passed through the fixing nip N, and FIG. 10B is the diagram illustrating the variation in physical properties of the toner in the fixing nip N. An x-axis represents a length of a portion of an external diameter E of the rotating member 110, and a y-axis represents temperature T of the toner. On the x-axis, N1 means an inlet of the fixing nip N, and N2 means an outlet thereof. The printing medium S is fed into N1 of the fixing nip N and then is escaped through N2.

A cartridge 200 for a recording medium according to another example of the present disclosure may include a recording medium supporting portion 211 for rotatably supporting a rotating center of a recording medium 201, a de-curl roller supporting portion 212 into which a de-curl roller 220 is movably inserted, and an extending portion 213 for connecting the recording medium supporting portion 211 with the de-curl roller supporting portion 212.

Temperature of the toner is gradually increased between N1 and N2. Heat is delivered by the heat source to the printing medium S being passed through the fixing nip N, and then the temperature of the toner in the form of powder, which has been transferred onto the printing medium S, is gradually increased by the delivered heat as the printing medium S is being transported from N1 to N2. The toner is continuously supplied with the heat while being passed through the fixing nip N, so that the toner may have a highest temperature just before being escaped from the fixing nip N during a section thereof.

A complex modulus 11 of the toner may be gradually reduced from N1 to N2. The complex modulus means a magnitude of elastic energy accumulated in an object or a material, and thus it is a coefficient which is gradually reduced as changing from a solid state to a liquid state. If the toner in a state of powder is supplied with heat while being transported from N1 to N2, a state change of the toner occurs from a solid state having a constant shape to a liquid gel state having a non-constant shape such that a complex modulus of the toner is reduced.

Therefore, the temperature of the toner is increased as being transported from the inlet N1 of the fixing nip N to the outlet N2 thereof and the complex modulus of the toner is reduced such that the toner becomes a state similar to the liquid gel state having a non-constant shape.

Figure 10C:
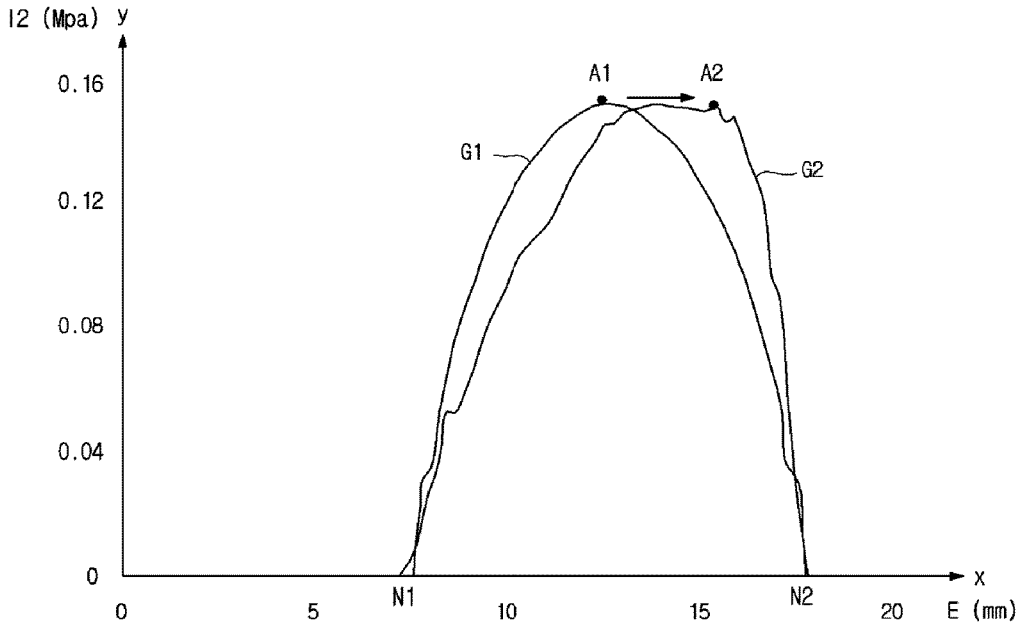

FIG. 10C is a graph showing pressure distribution applied to the printing paper by the fixing device according to an example.

In FIG. 10C, a graph of pressure applied to the printing medium S in the fixing nip N when the printing medium S is being passed through the fixing device 100 is shown. An x-axis represents the length of the portion of the external diameter E of the rotating member 110, and a y-axis represents a pressure 12 applied to the printing medium S. On the x-axis, N1 represents the inlet of the fixing nip N and N2 represents the outlet thereof. The printing medium S is fed into N1 of the fixing nip N and then is escaped through N2.

G1 is a graph in connection with a conventional fixing device which is not equipped with the protrusion 147. G2 is a graph in connection with the fixing device 100 according to an example, which is equipped with the protrusion 147 at the rear half of the fixing nip N.

In the conventional fixing device, a printing medium being passed through a fixing nip is subject to a maximum pressure at a center point of the fixing nip. However, in the fixing device 100, the printing medium S being passed through the fixing nip N may be subject to a greater pressure at the rear half of the fixing nip N than the center point thereof.

If a peak point of pressure applied to a printing medium in the conventional fixing device is referred to as A1, and a peak point of pressure applied to the printing medium S in the fixing device 100 is referred to as A2, A2 may be positioned adjacent to N2 on the rear half of the fixing nip N in comparison with A1. For example, in the fixing device 100, the peak point A2 of pressure applied to the printing medium S being passed through the fixing nip N may be positioned at a point where a lowest point of the protrusion 147 exists.

In this way, the maximum pressure is applied to the printing medium S by the protrusion 147 provided on the rear half of the fixing nip N when the toner transferred onto the printing medium S is supplied with heat while being passed through the fixing nip N to become a liquid gel state of a high temperature, such that the toner may be fixed onto the printing medium S. In such a case, a surface of the toner image fixed onto the printing medium S may be sleekly formed to improve gloss and gloss uniformity in comparison with the related art.

Figure 11A:
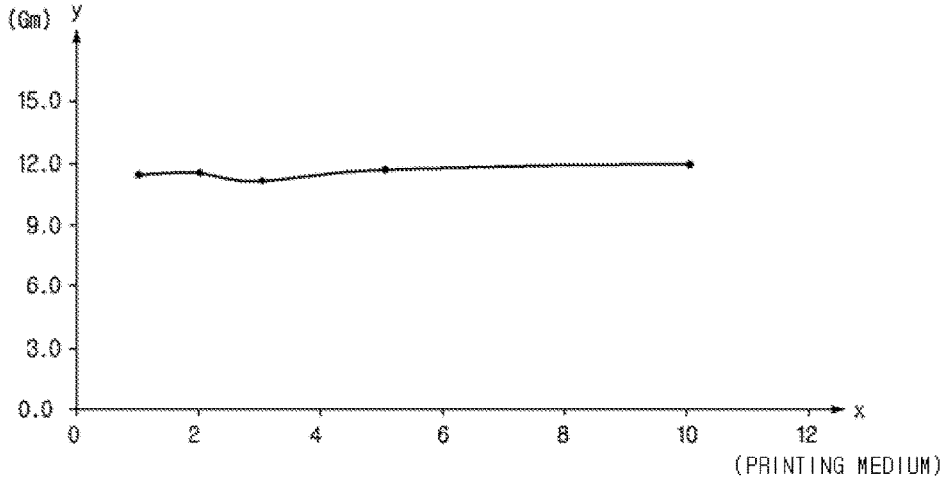
FIGS. 11A and 11B are diagrams for describing gloss of an image output on the printing paper according to an example.
Figure 11B:
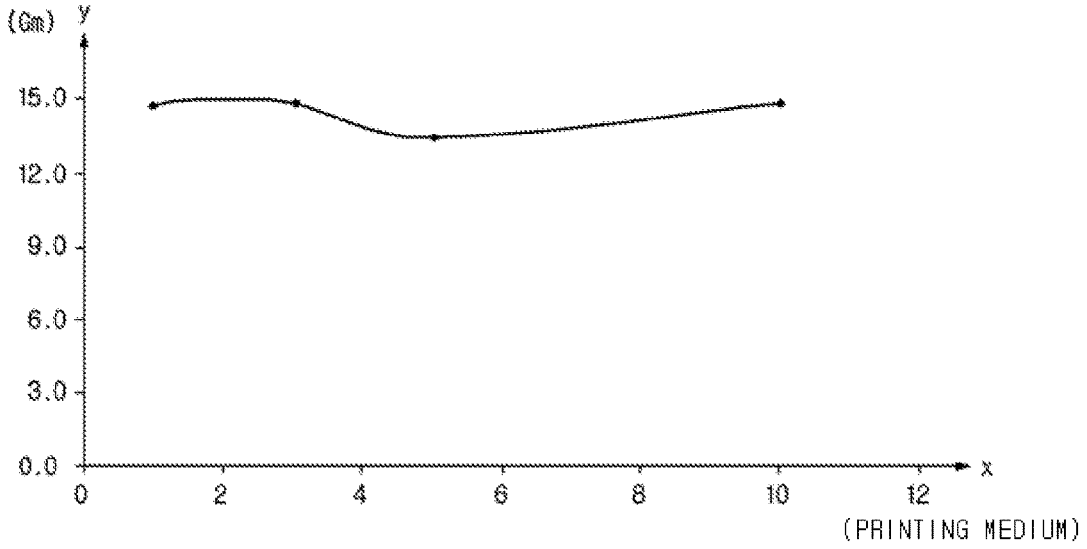

FIGS. 11A and 11B are diagrams for describing gloss of an image output onto the printing paper.

FIG. 11A shows gloss of an output image with respect to each printing medium resulting from the conventional fixing device equipped without a protrusion, whereas FIG. 11B shows gloss Gm of an output image with respect to each printing medium S resulting from the fixing device 100 when other conditions are the same except for the fixing device 100.

For example, numerals such as 1, 2, 3, and etc. on an x-axis represent a first printing medium, a second printing medium, a third printing medium, and etc., respectively. Lines shown in FIGS. 11A and 11B are lines connecting the gloss of the output images with respect to each printing medium.

As can be seen from the drawings, the greater the gloss, the better the gloss of the output image by the toner. The gloss of the printing medium S resulting from the fixing device 100 may be higher than that of the printing medium resulting from the conventional fixing device.

For example, as shown in FIG. 11A, an average of the gloss of the output images of the printing media resulting from the conventional fixing device may be approximately 11.6. As shown in FIG. 11B, an average of the gloss of the output images of the printing media S resulting from the fixing device 100 equipped with the protrusion 147 may be approximately 14.7. Therefore, when the fixing device 100 equipped with the protrusion 147 is adopted, the gloss of the output image of the printing medium S may be improved in comparison with that of the output image resulting from the conventional fixing device.

As such, the protrusion 147 is formed on the rear half of the fixing nip N to apply the maximum pressure to the printing medium S in a state in which the toner has been melted sufficiently, such that the gloss of the output image of the printing medium S may be increased to enhance quality of the output image.

Figure 12A:
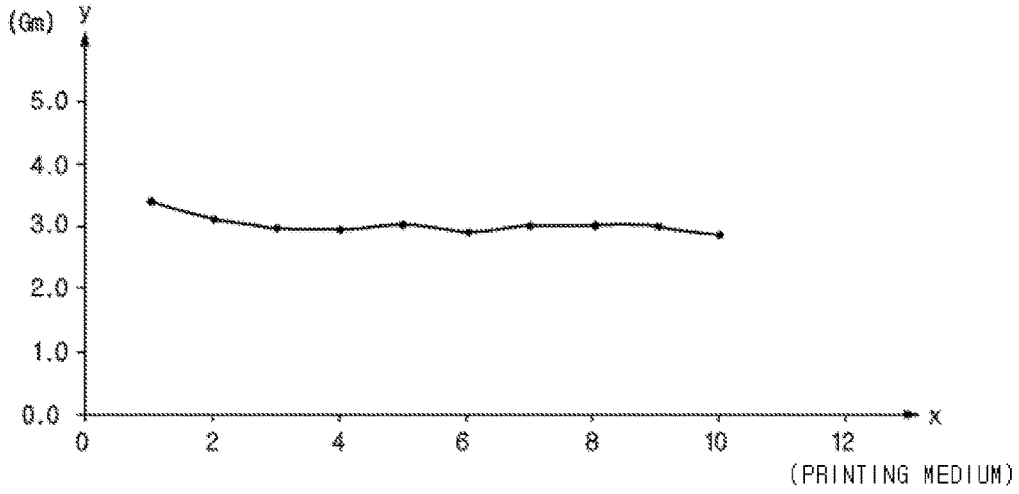
FIGS. 12A and 12B are diagrams for describing gloss uniformity of the image output on the printing paper according to an example.
Figure 12B:
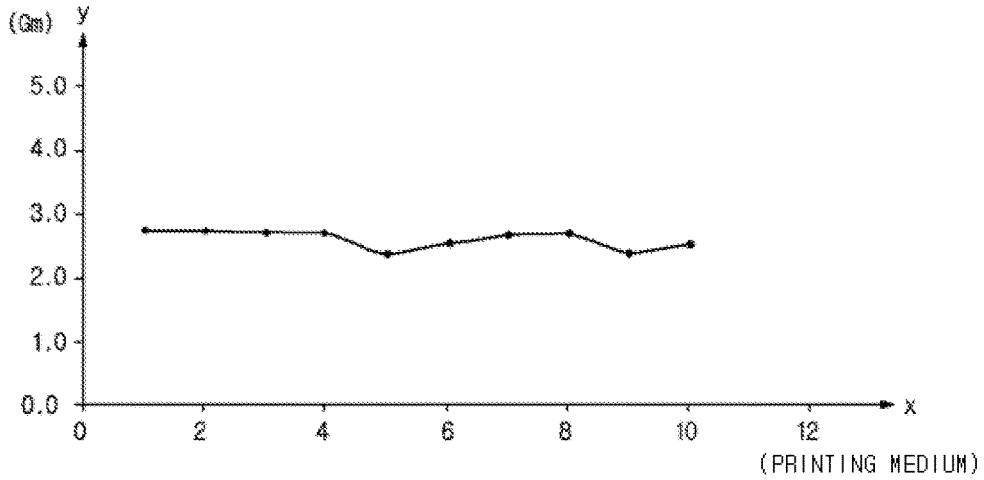

FIGS. 12A and 12B are diagrams for describing gloss uniformity of an image output on the printing paper.

FIG. 12A shows gloss uniformity of an output image with respect to each printing medium resulting from the conventional fixing device, whereas FIG. 12B shows gloss uniformity of an output image with respect to each printing medium S resulting from the fixing device 100 according to an example when other conditions are the same except for the fixing device 100.

For example, numerals such as 1, 2, 3, and etc. on an x-axis represent a first printing medium, a second printing medium, a third printing medium, and etc., respectively. Lines shown in FIGS. 12A and 12B are lines connecting the gloss uniformity of the output images with respect to each printing medium.

The smaller the gloss uniformity, the sleeker the surface of the output image resulting in forming the gloss evenly. The gloss uniformity of the output image of the printing medium S resulting from the fixing device 100 equipped with the protrusion 147 may be better than that of the output image of the printing medium resulting from the conventional fixing device.

For example, as shown in FIG. 12A, an average of the gloss uniformity of the output images resulting from the conventional fixing device may be approximately 4.3. As shown in FIG. 12B, an average of the gloss uniformity of the output images resulting from the fixing device 100 equipped with the protrusion 147 may be approximately 2.6. Therefore, when the fixing device 100 equipped with the protrusion 147 is adopted, the gloss uniformity of the output image may be improved in comparison with that of the output image resulting from the conventional fixing device.

As such, the protrusion 147 is formed on the rear half of the fixing nip N to apply the maximum pressure to the printing medium S in a state in which the toner has been melted sufficiently, such that the gloss uniformity of the output image of the printing medium S may be decreased to enhance quality of the output image.

Figure 13:
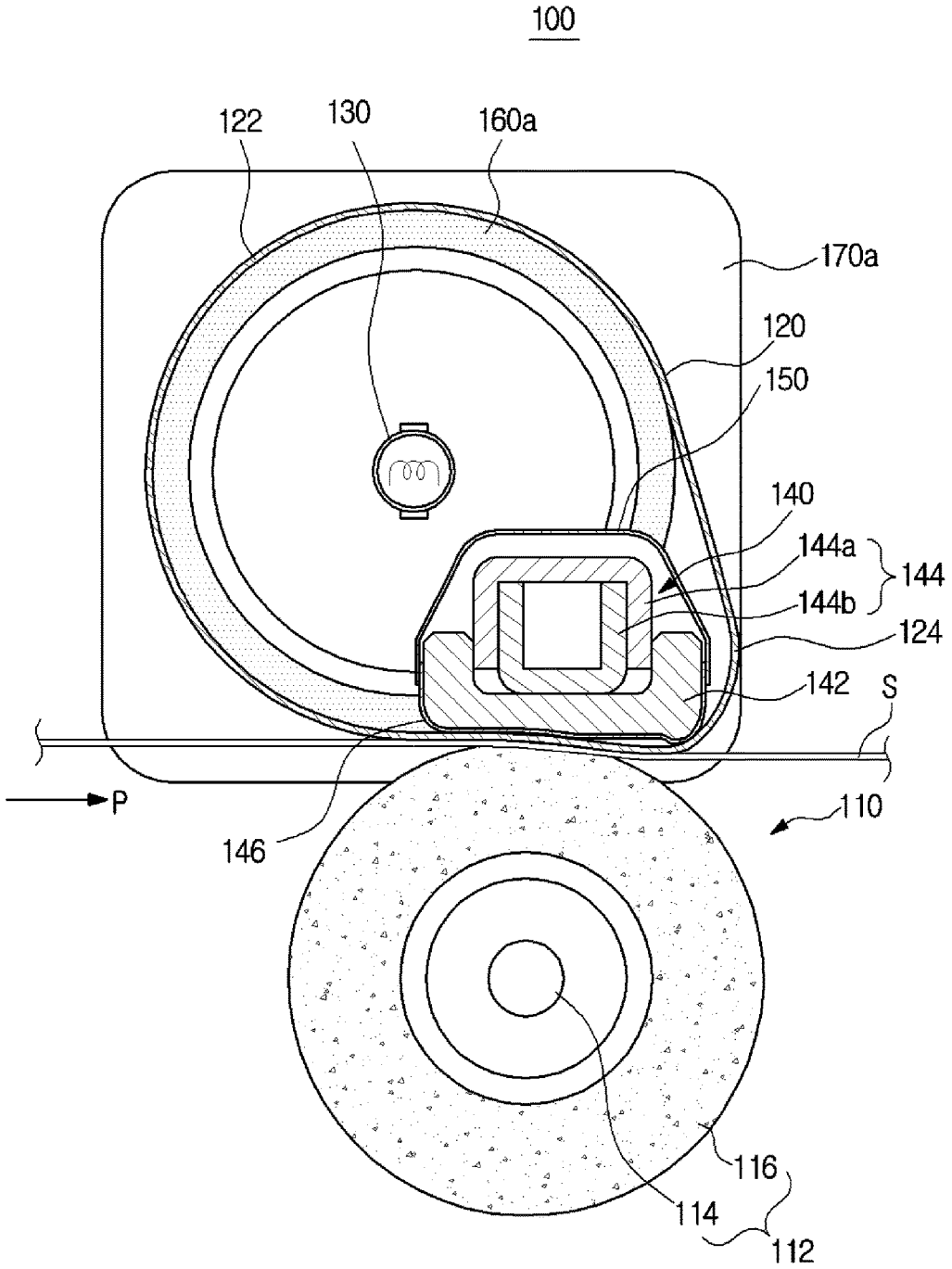
FIG. 13 is a cross-sectional diagram of a fixing device according to an example.
Figure 14:
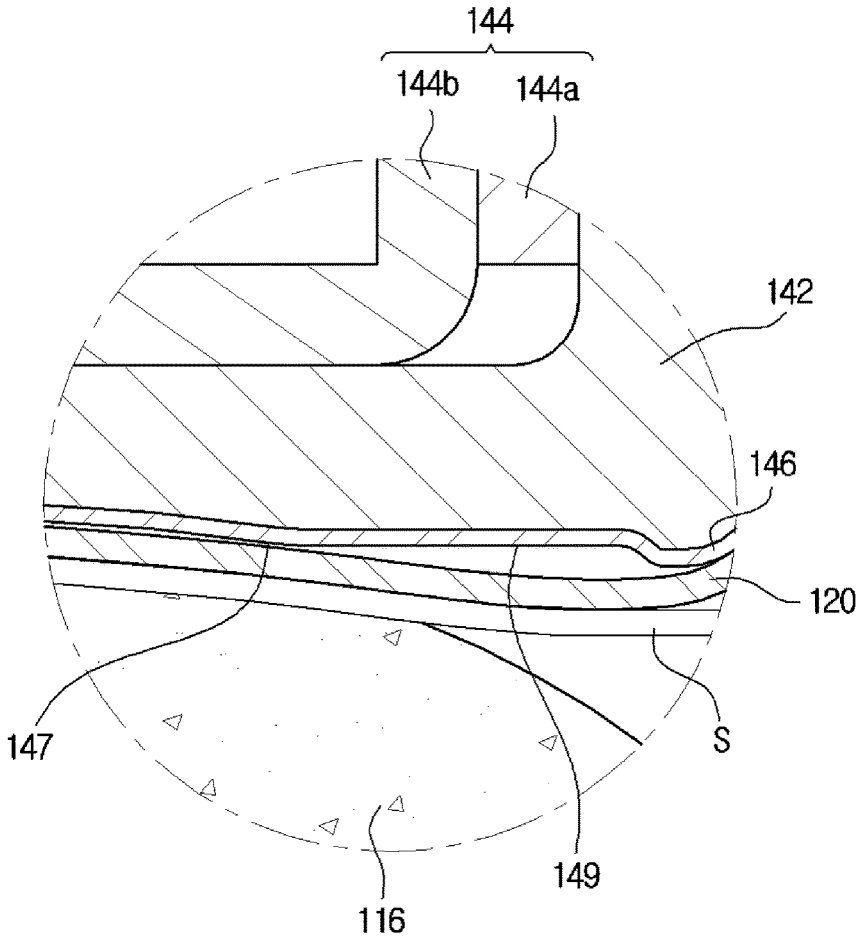
FIG. 14 is a diagram illustrating a part of the fixing device shown in FIG. 13 according to an example.

FIG. 13 is a cross-sectional diagram of a fixing device according to another example, and FIG. 14 is a diagram illustrating a part of the fixing device shown in FIG. 13.

With reference to FIGS. 13 and 14, the protrusion 147 and a step portion 149 may be provided on the lower surface of the nip forming member 140 of the fixing device 100 according to another example. The protrusion 147 is provided on the rear half of the fixing nip N to pressurize the printing medium S. The step portion 149 may be provided outside the fixing nip N.

The description of the protrusion 147 disclosed in FIGS. 8 and 9 may be similarly applicable to the protrusion 147. The protrusion 147 may be provided on the lower surface of the guide member 142 or the friction reducing plate 146. The maximum pressure is applied to the printing medium S by the protrusion 147 provided on the rear half of the fixing nip N, such that a high temperature toner being sufficiently melted may be fixed onto the printing medium S. In this way, the gloss and gloss uniformity of the output image may be improved.

The step portion 149 may be formed on the lower surface of the nip forming member 140, which is positioned outside the rear half of the fixing nip N. The lower surface of the friction reducing plate 146 may be formed to be stepped upwardly, or may be provided in an upwardly concave shape. In the case that the friction reducing plate 146 is not provided separately, an upwardly stepped shape or an upwardly concave shape may be formed on the guide member 142.

Pressure applied by the fixing belt 120 to the printing medium S may be abruptly reduced at the step portion 149. The fixing belt 120 may be formed to have a downward curve by the protrusion 147, and then, may be naturally bended by an outer lateral surface of the nip forming member 140 after passing through the protrusion 147.

With a structure such as an envelope of which two sheets are superposed in a vertical direction and rear halves thereof are connected to each other by means of an adhesive, the printing medium S is subject to a high pressure by the protrusion 147. While the printing medium S is transported along with the fixing belt 120 having a predetermined curvature, an offset due to a movement difference between an upper surface and a lower surface of the printing medium S occurs by pressure applied from the protrusion 147. When the offset between the upper surface and the lower surface of the printing medium S occurs, creases may occur on the printing medium.

In order to prevent creases due to an offset from occurring on the printing medium, a difference in movement distance between the upper surface and the lower surface of the printing medium S may be overcome at the step portion 149 where pressure applied to the printing medium S is low after the printing medium S has been passed through the protrusion 147.

In this way, when a printing medium such as an envelope made of a two-layer sheet and having one ends adhered to each other is used, an offset due to a difference in movement distance between an upper surface of the two-layer sheet and a lower surface thereof may be compensated by a high pressure by the protrusion 147 to allow the printing medium to be transported smoothly.

Figure 15:
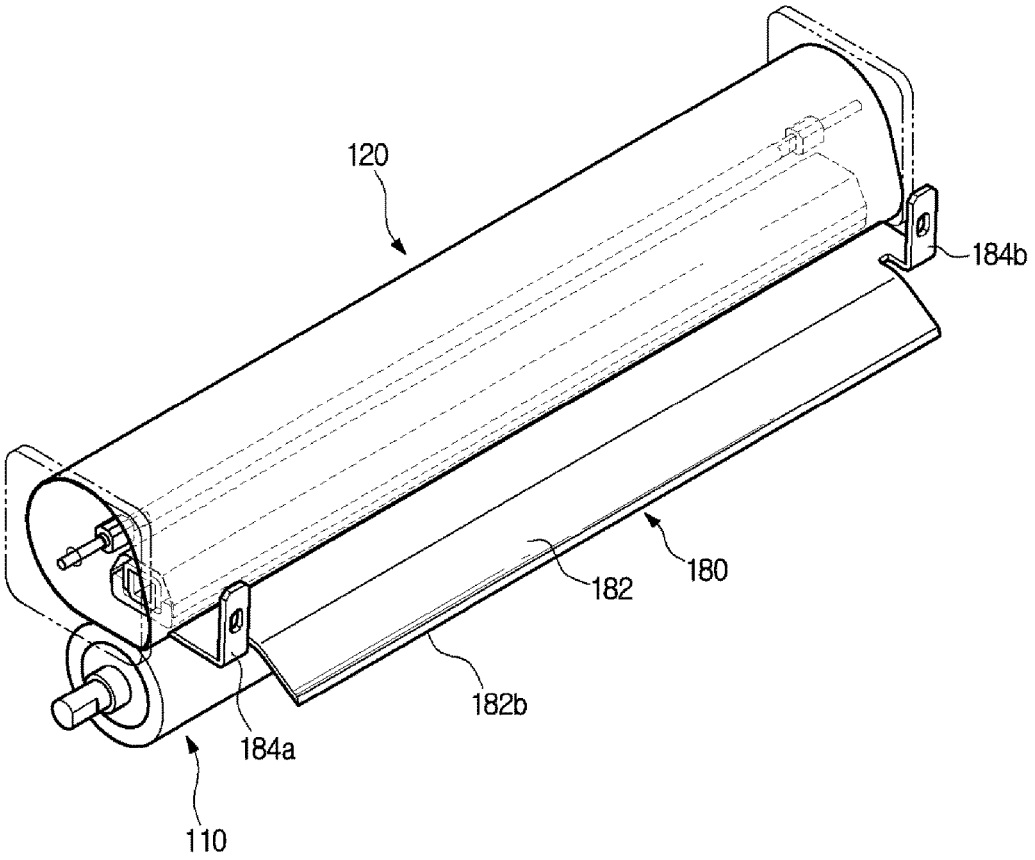
FIG. 15 is a perspective diagram of a fixing device according to according to another example.
Figure 16:
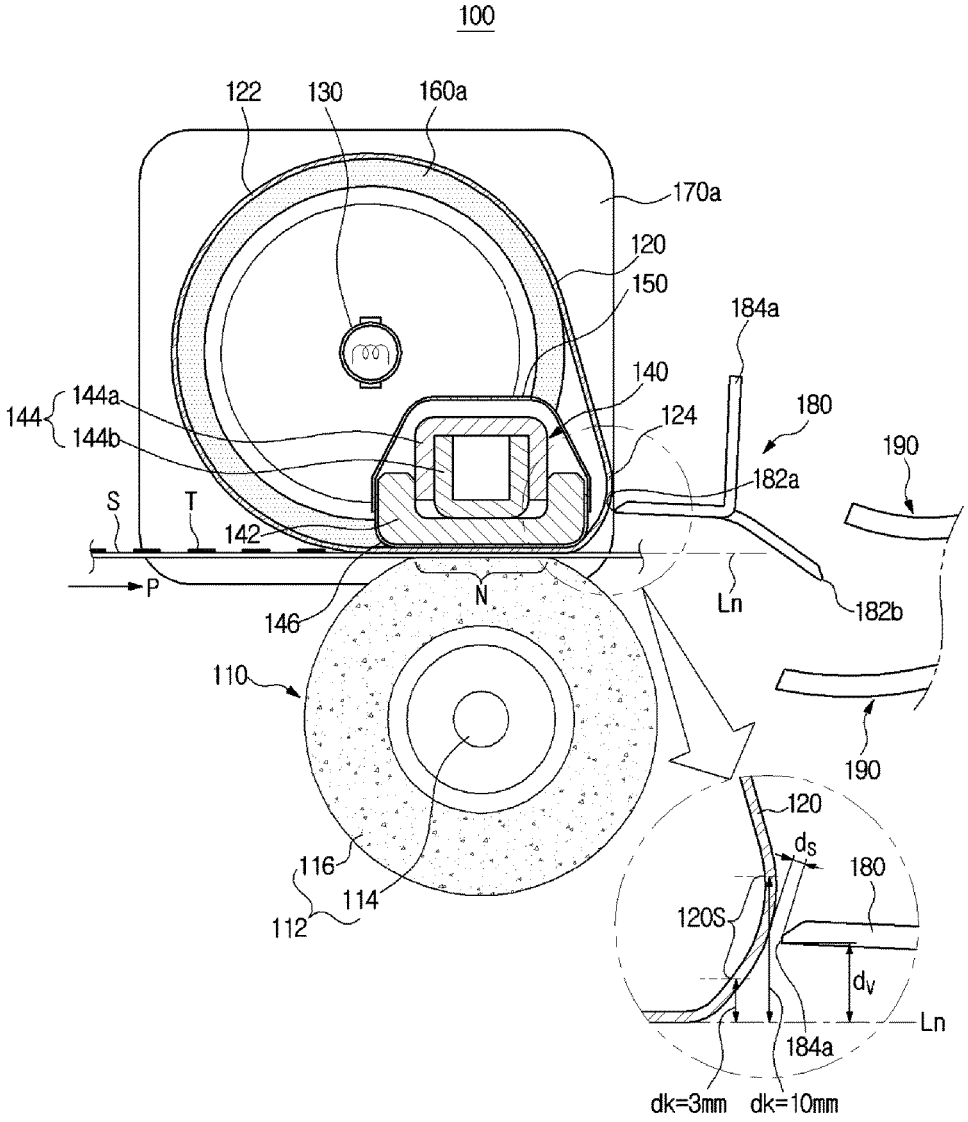
FIG. 16 is a cross-sectional diagram of the fixing device shown in FIG. 15.
Figure 17:
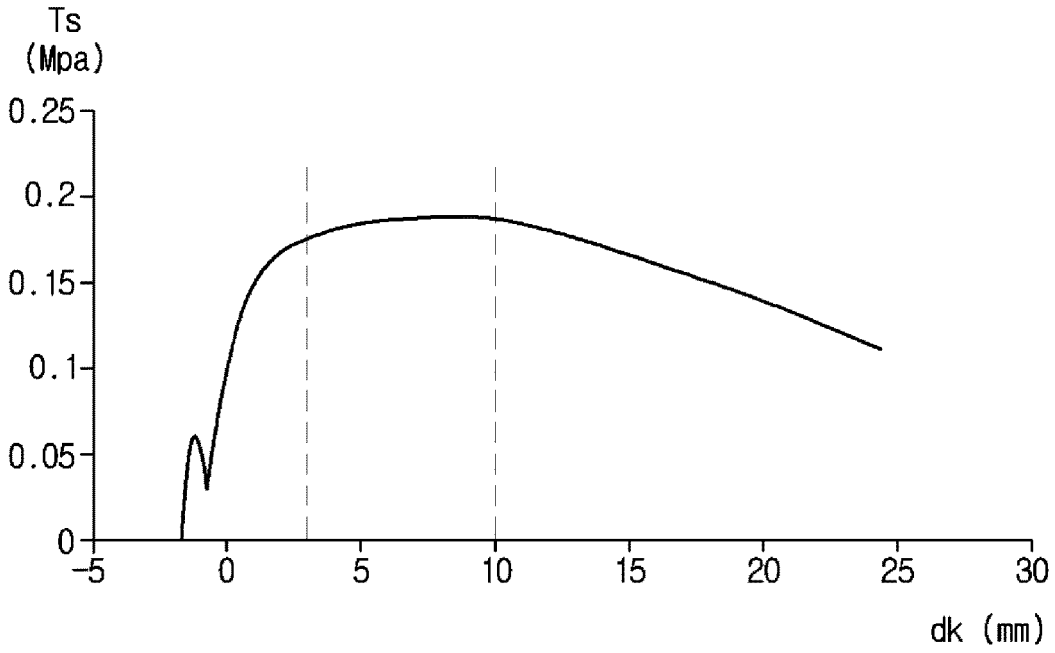
FIG. 17 is a graph showing a magnitude of a separating force between the fixing belt and a toner layer according to a vertical distance between the fixing nip N and the fixing belt according to an example.

FIG. 15 is a perspective diagram of a fixing device according to another example, and FIG. 16 is a cross-sectional diagram of the fixing device shown in FIG. 15. FIG. 17 is a graph showing a magnitude of a separating force between the fixing belt and the toner layer according to a vertical distance between the fixing nip N and the fixing belt. In FIG. 17, a horizontal axis represents a vertical distance dk between the fixing nip N and the fixing belt, and a vertical axis represents a magnitude of a separating force Ts between the fixing belt and the toner layer.

As shown in FIGS. 15 and 16, the fixing device 100 includes a baffle 180 arranged on a downstream side of the fixing nip N. The baffle 180 is a separating member for guiding a leading edge of the printing medium S so as to separate from the fixing belt 120, the leading edge of the printing medium S being passed through the fixing nip N.

The baffle 180 includes a main body 182 provided in a shape bending in a reverse direction to a rotation direction of the fixing belt 120, and fastening members 184*a* and 184*b* spaced apart from each other to be provided on both ends of the main body 182 in a width direction X of the rotating member 110. The fastening members 184*a* and 184*b* are coupled to the main body frame (not shown) to fasten the baffle 180 thereto. One end 182*a* of the main body 182 is arranged relatively closer to the fixing belt 120 than the other end 182*b* of the main body 182.

The one end 182*a* of the main body 182 is arranged closer to the fixing belt 120 than the rotating member 110 on the basis of an imaginary line Ln extending from the fixing nip N, and the other end 182*b* of the main body 182 is arranged closer to the rotating member 110 than the fixing belt 120 on the basis of the imaginary line Ln extending from the fixing nip N.

In a general belt-type fixing device, there may be a concern about occurrence of a wrap-jam phenomenon in which a printing medium being passed through a fixing nip is rotated together with a fixing belt in a state of attachment thereto instead of separation therefrom to be wound around the fixing belt due to an adhesive property of a toner being melted by heat from a heat source.

As described above, the one end 182*a* of the main body 182 of the baffle 180 is arranged closer to the fixing belt 120 than the rotating member 110 and the other end 182*b* of the main body 182 of the baffle 180 is arranged closer to the rotating member 110 than the fixing belt 120 on the basis of the imaginary line Ln extending from the fixing nip N, and the main body 182 of the baffle 180 is provided in the shape bending from the one end 182*a* to the other end 182*b* in a reverse direction to a rotation direction of the fixing belt 120, such that the printing medium S being passed through the fixing nip N is stably separated from the fixing belt 120 by the baffle 180 to prevent the wrap-jam phenomenon.

While being passed through the fixing nip N to be escaped therefrom, the printing medium S should be naturally separated from the fixing belt 120 or the rotating member 110, and to this end, a separating force equal to or greater than a predetermined magnitude should be applied between the fixing belt 120 and the toner layer T on the printing medium S. The separating force Ts between the fixing belt 120 and the toner layer T is relatively high in the vicinity of a position where the printing medium S is escaped from the fixing nip N, and in particular, as shown in FIG. 17, the separating force Ts between the toner layer T and a portion 120S of the fixing belt 120 positioned in the range of 3 mm to 10 mm in a vertical direction from the fixing nip N is relatively highest compared to the other portions of the fixing belt 120. Therefore, by arranging the one end 182*a* of the baffle 180 at a position adjacent to the portion 120S of the fixing belt 120 positioned in the range of 3 mm to 10 mm in the vertical direction from the fixing nip N, the printing medium S being passed through the fixing nip N may be more stably separated from the fixing belt 120 by the baffle 180. In other words, the baffle 180 is arranged to set a vertical distance dv between the one end 182*a* of the baffle 180 adjacent to the fixing belt 120 and the fixing nip N to 3 mm to 10 mm.

In order to prevent the fixing belt 120 from being damaged by the baffle 180 while the fixing belt 120 is rotating, the one end 182*a* of the baffle 180 should be spaced apart at a distance from the surface of the fixing belt 120. A shortest distance ds between the fixing belt 120 and the one end 182*a* of the baffle 180 should be determined by sufficiently considering properties (a shape, a circumferential length, and a material) of the fixing belt 120, temperature of heating the fixing belt 120 by the heat source 130, and the like. For example, if the fixing belt 120 has an easily expandable property and also is used in a heated environment at a high temperature, the shortest distance ds between the fixing belt 120 and the one end 182*a* of the baffle 180 should be set to a relatively long distance. On the contrary, if the fixing belt 120 has a greater resistance property to expansion and is used in a heated environment at a low temperature, the shortest distance ds between the fixing belt 120 and the one end 182*a* of the baffle 180 may be set to a relatively short distance.

The baffle 180 is arranged to set the shortest distance ds between the fixing belt 120 and the one end 182*a* of the baffle 180 to 0.5 mm to 3 mm. If the shortest distance ds between the fixing belt 120 and the one end 182*a* of the baffle 180 is less than 0.5 mm, a phenomenon in which the fixing belt 120 expands to be damaged by the baffle 180 may occur. Otherwise, if the shortest distance ds between the fixing belt 120 and the one end 182*a* of the baffle 180 is greater than 3 mm, the damage due to the expansion of the fixing belt 120 may be stably prevented but a printing medium separation function of the baffle 180 may be degraded.

As shown in FIGS. 1 and 16, a pair of guide ribs 190 are arranged between the fixing device 100 and the printing medium discharge device 70. The pair of guide ribs 190 are arranged to be spaced apart from each other, thereby forming a transport path through which the printing medium S is transported, and guide transportation of the printing medium S between the fixing device 100 and the printing medium discharge device 70.

The other end 182*b* of the baffle 180 is arranged between the pair of guide ribs 190. The printing medium S having been passed through the fixing nip N is stably separated from the fixing belt 120 by the one end 182*a* of the baffle 180, and then is guided between the pair of guide ribs 190 by the other end 182*b* of the baffle 180.

Heretofore, one configuration in which the baffle 180 is included in the fixing device 100 has been described, but the baffle 180 may be configured as a separation device 180 which is provided in isolation from the fixing device 100.

As described above, examples have been described in an illustrative manner. The terms used herein are intended to describe examples. Many modifications and variations of examples in accordance with the description may be possible.

What is claimed is:

1. A fixing device to apply pressure to a printing medium, comprising:

a fixing belt arranged to be rotatable;

a rotating member arranged to be in engagement with an outer circumferential surface of the fixing belt;

a nip forming member to press the fixing belt, to form a fixing nip between the fixing belt and the rotating member; and sliding members arranged on both ends of the fixing belt and to rotate together with the fixing belt, wherein a circumference of an outer surface of each of the sliding members is in partial contact with an inner surface of the fixing belt.

2. The fixing device of claim 1, wherein a rotation center of each of the sliding members is arranged on an upstream side of a feeding direction of the printing medium into the fixing device compared to a rotation center of the rotating member, and a shortest distance between a tangential line parallel to the fixing nip, of an outer circumferential surface of each of the sliding members and the rotation center of the rotating member is greater than a shortest distance between the fixing nip and the rotation center of the rotating member.

3. The fixing device of claim 1, wherein the nip forming member includes:

a guide member to guide the fixing belt in contact with the inner surface of the fixing belt; and a support member arranged on an upper portion of the guide member to support the guide member.

4. The fixing device of claim 1, wherein the nip forming member includes:

a guide member to guide the fixing belt;

at least one support member arranged on an upper portion of the guide member to support the guide member; and a friction reducing plate arranged between the fixing belt and the guide member to reduce friction between the fixing belt and the guide member.

5. The fixing device of claim 3, wherein at least a portion of the support member is accommodated on an inner side of the guide member.

6. The fixing device of claim 1, further comprising:

a heat source to heat the fixing belt; and a thermal insulation member to cover at least a portion of the nip forming member, to prevent heat generated from the heat source from directly radiating to the nip forming member.

7. The fixing device of claim 1, further comprising:

a heat source to heat the fixing belt, wherein the heat source is any one or any combination of a halogen lamp arranged at an inner side of the fixing belt, a ceramic heater coupled to a lower surface of the nip forming member, or a planar heating element provided on the fixing belt.

8. The fixing device of claim 1, further comprising:

a flange member arranged on the both ends of the fixing belt to support the sliding members in an axial direction of each of the sliding members.

9. The fixing device of claim 8, wherein each flange member includes:

a rotation supporter to rotatably support the sliding members in contact with an inner circumferential surface of each of the sliding members; and a release preventer provided on both sides of the rotation supporter to prevent the sliding members from being released in the axial direction.

10. The fixing device of claim 1, wherein a ratio between the circumference of the outer surface of each of the sliding members and a circumference of the inner surface of the fixing belt is equal to or greater than 0.15 and equal to or less than 0.98.

11. The fixing device of claim 10, wherein the fixing belt includes a first portion in contact with the sliding members and a second portion in non-contact with the sliding members while the fixing belt is rotating, the fixing nip is formed between the first portion and the second portion, and a radius of curvature of the first portion is greater than a radius of curvature of at least a section of the second portion.

12. The fixing device of claim 11, wherein a curvature of a portion of the second portion, which is connected to the fixing nip, is greater than a curvature of a remaining portion of the second portion.

13. A fixing device to apply heat and pressure to a printing medium for an image forming apparatus, comprising:

a fixing belt arranged to deliver heat in contact with a surface of the printing medium;

a rotating member arranged to press-contact to an outer circumferential surface of the fixing belt, to form a fixing nip between the fixing belt and the rotating member; and a nip forming member to press an inner circumferential surface of the fixing belt, wherein the nip forming member includes a protrusion protruding from a lower surface of the nip forming member to be in contact with the inner circumferential surface of the fixing belt, to press the inner circumferential surface of the fixing belt toward the rotating member, and wherein the nip forming member further includes a step portion formed in an upwardly concave shape provided on the lower surface of the nip forming member.

14. The fixing device of claim 13, wherein the protrusion is positioned inside the fixing nip.

15. The fixing device of claim 13, wherein the protrusion is provided to be adjacent to an outlet side of the fixing nip.

16. The fixing device of claim 13, wherein the step portion is formed outside the fixing nip.

17. The fixing device of claim 13, wherein the step portion is positioned to be adjacent to an outlet of the fixing nip.

18. The fixing device of claim 13, wherein the nip forming member includes:

a guide member to guide the fixing belt in contact with the fixing belt; and a support member arranged on an upper portion of the guide member to support the guide member.

19. A fixing device to apply pressure to a printing medium for an image forming apparatus, comprising:

a fixing belt arranged to be rotatable;

a rotating member arranged to be in engagement with an outer circumferential surface of the fixing belt;

a nip forming member to press the fixing belt, to form a fixing nip between the fixing belt and the rotating member; and a baffle arranged at a downstream side of the fixing nip, the baffle having a first end arranged closer to the fixing belt than to the rotating member and a second end arranged closer to the rotating member than to the fixing belt.

20. The fixing device of claim 19, wherein the first end of the baffle is arranged closer to the fixing belt than the rotating member with respect to a tangential line tangent to the fixing nip, and a vertical distance between the first end of the baffle adjacent to the fixing belt and the fixing nip is equal to or greater than about 3 mm and equal to or less than about 10 mm.

* * * * *